US012698945B1

(12) United States Patent
Carpenter et al.

(10) Patent No.: US 12,698,945 B1
(45) Date of Patent: Aug. 4, 2026

(54) BLIND FOR ATTACHMENT TO A BOW

(71) Applicant: William Shannon Carpenter, Kitts Hill, OH (US)

(72) Inventors: William Shannon Carpenter, Kitts Hill, OH (US); Steven Andrew Sauer, Columbus, OH (US); Jeffrey David Myers, Upper Arlington, OH (US)

(73) Assignee: Oak Ridge Innovation, LLC, Kitts Hill, OH (US)

( * ) Notice: Subject to any disclaimer, the term of this patent is extended or adjusted under 35 U.S.C. 154(b) by 84 days.

(21) Appl. No.: 18/792,459

(22) Filed: Aug. 1, 2024

Related U.S. Application Data

(60) Provisional application No. 63/530,193, filed on Aug. 1, 2023.

(51) Int. Cl.
*F41B 5/14* (2006.01)

(52) U.S. Cl.
CPC ..... *F41B 5/1496* (2013.01)

(58) Field of Classification Search
CPC ..... F41B 5/14; F41B 5/1496; F41H 3/00; A01M 31/06
See application file for complete search history.

(56) References Cited

U.S. PATENT DOCUMENTS 295,013 A * 3/1884 Hunter ..... F41H 5/12 160/134
3,179,102 A * 4/1965 Peckham ..... F41B 5/1496 124/88
4,817,579 A * 4/1989 Mathias ..... F41B 5/1496 135/901
4,876,817 A * 10/1989 Hill ..... F41H 3/00 124/88
5,127,180 A * 7/1992 Norton ..... A01M 31/00 135/901
5,235,772 A * 8/1993 Mendick, Jr. ..... F41B 5/1496 135/901
5,944,041 A * 8/1999 Kitchens ..... E04H 15/001 135/901
7,275,532 B2 * 10/2007 Niemackl ..... F41H 3/02 124/23.1
7,958,878 B2 * 6/2011 Hoffmann ..... F41H 3/02 124/25
8,720,428 B2 * 5/2014 Jantzen ..... E04H 15/001 124/86
9,016,298 B2 * 4/2015 Mausen ..... E04H 15/001 135/96
10,477,858 B2 * 11/2019 Pauley ..... A01M 31/06
10,980,227 B1 * 4/2021 Bednar ..... A01M 31/06
11,058,104 B1 * 7/2021 Cain, Jr. ..... A01M 31/06
(Continued)

*Primary Examiner* — Joshua E Freeman
(74) *Attorney, Agent, or Firm* — MIP Legal, Ltd.; Bryce D. Miracle

(57) ABSTRACT

The present invention discloses a bow blind designed for connection to an archery bow, comprising a fan portion and a mounting bracket affixed to the fan portion. The mounting bracket is capable of being securely attached to the archery bow, while the fan portion is structured to move radially between a retracted state and an unfurled state. This innovative bow blind provides archers with a versatile and efficient solution for concealing themselves during hunting activities, offering ease of use and enhanced functionality in the field.

22 Claims, 20 Drawing Sheets

(56) References Cited

U.S. PATENT DOCUMENTS

| | | | | |
|---|---|---|---|---|
| 2013/0174826 | A1* | 7/2013 | Faherty | F41H 3/02 135/98 |
| 2013/0255737 | A1* | 10/2013 | Jantzen | E04H 15/001 135/121 |
| 2014/0261595 | A1* | 9/2014 | Mausen | A01M 31/025 135/96 |
| 2020/0256633 | A1* | 8/2020 | Keller | F41B 5/1492 |

* cited by examiner

SECTION B-B

SECTION C-C

SECTION C-C

BLIND FOR ATTACHMENT TO A BOW

CROSS-REFERENCE TO RELATED APPLICATION

This application is based upon and claims the priority filing date of the previously filed, U.S. Provisional patent application entitled "PORTABLE BLIND FOR ATTACHMENT TO A BOW," filed Aug. 1, 2024, having App. No. 63/530,193, the entire disclosure of which is hereby incorporated herein by reference.

TECHNICAL FIELD

The present disclosure relates to hunting equipment, specifically to a portable blind designed for attachment to an archery bow.

BACKGROUND

When hunting for game such as deer or turkey, hunters often face the challenge of remaining concealed while drawing their bow. The movement involved in drawing the bowstring can easily be detected by the game, causing them to flee and ruining the hunt.

Previous approaches to providing concealment for archery hunters have involved various types of blinds that can be set up in the hunting area to hide the hunter from the view of game animals. These blinds typically require assembly and disassembly, making them less convenient for hunters who prefer a more mobile hunting experience. Additionally, traditional blinds may obstruct the hunter's line of sight or interfere with the operation of the bow, limiting the hunter's ability to take a shot effectively. Traditional hunting blinds can also be cumbersome and are not always practical for bow hunters who need to remain mobile and agile.

In light of the limitations of current bow blinds, there remains a need for an improved bow blind that offers enhanced concealment, ease of use, and flexibility in adjusting the blind to different hunting conditions. However, none of these approaches has provided a comprehensive solution that combines the features described in this disclosure.

SUMMARY

The above features and advantages and other features and advantages of the present teachings are readily apparent from the following detailed description of the best modes for carrying out the present teachings when taken in connection with the accompanying drawings.

In some aspects, the techniques described herein relate to a bow blind configured for attachment to an archery bow, the bow blind including: a fan portion; and a mounting bracket attached to the fan portion; wherein the mounting bracket is operably attachable to the archery bow; wherein the fan portion is configured to radially move between a retracted position and an unfurled position.

In some aspects, the techniques described herein relate to a bow blind, wherein the fan portion includes a plurality of spokes and a flexible material operatively attached to the plurality of spokes; wherein when the bow blind is in the unfurled position, the flexible material is radially expanded, forming a radial visual barrier.

In some aspects, the techniques described herein relate to a bow blind, wherein the plurality of spokes and the flexible material expand and retract between a uniform profile and a semi-circular profile.

In some aspects, the techniques described herein relate to a bow blind, wherein the plurality of spokes includes a first outer spoke, a second outer spoke, and a plurality of inner spokes, with the plurality of inner spokes sandwiched between the first outer spoke and the second outer spoke.

In some aspects, the techniques described herein relate to a bow blind, wherein each of the plurality of spokes is elongated in shape and extends between a proximal end and a distal end; wherein the plurality of spokes are aligned with one another along a pivot axis, near the proximal ends, such that the plurality of spokes pivot relative to one another about the pivot axis to move the flexible material between the retracted position and the unfurled position.

In some aspects, the techniques described herein relate to a bow blind, wherein each of the plurality of spokes defines a pivot hole, near the respective proximal end, with the pivot holes aligned with one another along the pivot axis; wherein the radial fan portion further includes a rod extending along the pivot axis, through the pivot holes, to pivotally interconnect the spokes.

In some aspects, the techniques described herein relate to a bow blind, wherein the mounting bracket is operatively attached to the first outer spoke.

In some aspects, the techniques described herein relate to a bow blind, wherein the mounting bracket is formed from a single piece of material as an L-shaped bracket.

In some aspects, the techniques described herein relate to a bow blind, wherein the mounting bracket includes a first leg and a second leg, extending from the first leg to define an angle therebetween.

In some aspects, the techniques described herein relate to a bow blind, wherein the first leg defines a pair of openings; wherein the pair of openings are disposed in spaced apart relationship to one another, configured to align with a pair of mounting holes provided on the archery bow.

In some aspects, the techniques described herein relate to a bow blind, wherein the second leg of the mounting bracket is configured for attachment to the first outer spoke of the fan portion.

In some aspects, the techniques described herein relate to a bow blind, wherein the fan portion further includes a connection member; wherein the mounting bracket further includes a slotted mounting block defining a longitudinal slot, extending therethrough, configured to receive and engage with the connection member.

In some aspects, the techniques described herein relate to a bow blind, wherein the connection member is integrally formed with the first outer spoke, near the proximal end, radially extending from the pivot axis.

In some aspects, the techniques described herein relate to a bow blind, wherein the connection member further defines a pair of reciprocal squeeze tabs providing a gap therebetween to allow lateral flexing, each having an upper flat catch and a lower flat catch, which are configured to simultaneously couple with the longitudinal slot when the connection member is fully inserted into the slotted mounting block.

In some aspects, the techniques described herein relate to a bow blind, wherein the mounting bracket further includes a sub-bracket extending from the slotted mounting block, defining an angle therebetween. The sub-bracket defines a pair of openings that are disposed in spaced apart relationship to one another, configured to align with a pair of mounting holes on the archery bow.

In some aspects, the techniques described herein relate to a bow blind configured for attachment to an archery bow, the bow blind including: a fan portion including: a plurality of spokes that are pivotally connected to one another at a pivot axis at a proximal end; and a flexible material operably connected to the plurality of spokes; and a mounting bracket configured to attach the fan portion to an archery bow; wherein the fan portion is configured to radially move between a retracted position and an unfurled position; wherein the plurality of spokes includes a first outer spoke, a second outer spoke, and a plurality of inner spokes, with the plurality of inner spokes sandwiched between the first outer spoke and the second outer spoke; wherein each of the plurality of spokes is elongated in shape and extends between a proximal end and a distal end; wherein the plurality of spokes are aligned with one another along a pivot axis, near the proximal ends, such that the plurality of spokes pivot relative to one another about the pivot axis to move the flexible material between the retracted position and the unfurled position.

In some aspects, the techniques described herein relate to a bow blind, wherein each of the plurality of spokes defines a pivot hole, near the respective proximal end, with the pivot holes aligned with one another along the pivot axis; wherein the fan portion further includes a rod extending along the pivot axis, through the pivot holes, to pivotally interconnect the plurality of spokes.

In some aspects, the techniques described herein relate to a bow blind, wherein the mounting bracket is operatively attached to the first outer spoke.

In some aspects, the techniques described herein relate to a bow blind, wherein the fan portion further includes a connection member; wherein the mounting bracket further includes a slotted mounting block defining a longitudinal slot, extending therethrough, configured to receive and engage with the connection member.

In some aspects, the techniques described herein relate to a bow blind, wherein the connection member is integrally formed with the first outer spoke, near the proximal end, radially extending from the pivot axis.

In some aspects, the techniques described herein relate to a bow blind, wherein the connection member defines a pair of reciprocal squeeze tabs providing a gap therebetween to allow lateral flexing, each having an upper flat catch and a lower flat catch, which are configured to simultaneously couple with the longitudinal slot when the connection member is fully inserted into the slotted mounting block.

In some aspects, the techniques described herein relate to a bow blind configured for attachment to an archery bow, the bow blind including: a fan portion including: a plurality of spokes that are pivotally connected to one another at a pivot axis at a proximal end; and a flexible material operably connected to the plurality of spokes; and a mounting bracket configured to attach the fan portion to an archery bow; wherein the fan portion is configured to radially move between a retracted position and an unfurled position; wherein the plurality of spokes includes a first outer spoke, a second outer spoke, and a plurality of inner spokes, with the plurality of inner spokes sandwiched between the first outer spoke and the second outer spoke; wherein each of the plurality of spokes is elongated in shape and extends between a proximal end and a distal end; wherein the plurality of spokes are aligned with one another along a pivot axis, near the proximate ends, such that the plurality of spokes pivot relative to one another about the pivot axis to move the flexible material between the retracted position and the unfurled position; wherein the fan portion further includes a connection member; wherein the mounting bracket further includes a slotted mounting block defining a longitudinal slot, extending therethrough, configured to receive and engage with the connection member; wherein the connection member is integrally formed with the first outer spoke, near the proximal end, radially extending from the pivot axis; wherein the connection member defines a pair of reciprocal squeeze tabs providing a gap therebetween to allow lateral flexing, each having an upper flat catch and a lower flat catch, which are configured to simultaneously couple with the longitudinal slot when the connection member is fully inserted into the slotted mounting block.

BRIEF DESCRIPTION OF THE DRAWINGS

Various features of the present invention will become more fully apparent from the following description and appended claims, taken in conjunction with the accompanying drawings. Understanding that these drawings depict only typical embodiments of the invention and are, therefore, not to be considered limiting of its scope, the embodiments of the invention will be described and explained with additional specificity and detail through the use of the accompanying drawings.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure. Furthermore, the drawings are in simplified form and are not to precise scale. For purposes of convenience and clarity only, directional terms such as top, bottom, left, right, up, down, upper, lower, upward, and downward may be used with respect to the drawings. These and similar directional terms are not to be construed to limit the scope of the disclosure in any manner. Additionally, the disclosure, as illustrated and described herein, may be practiced in the absence of any element that is not specifically disclosed herein.

Figure 1:
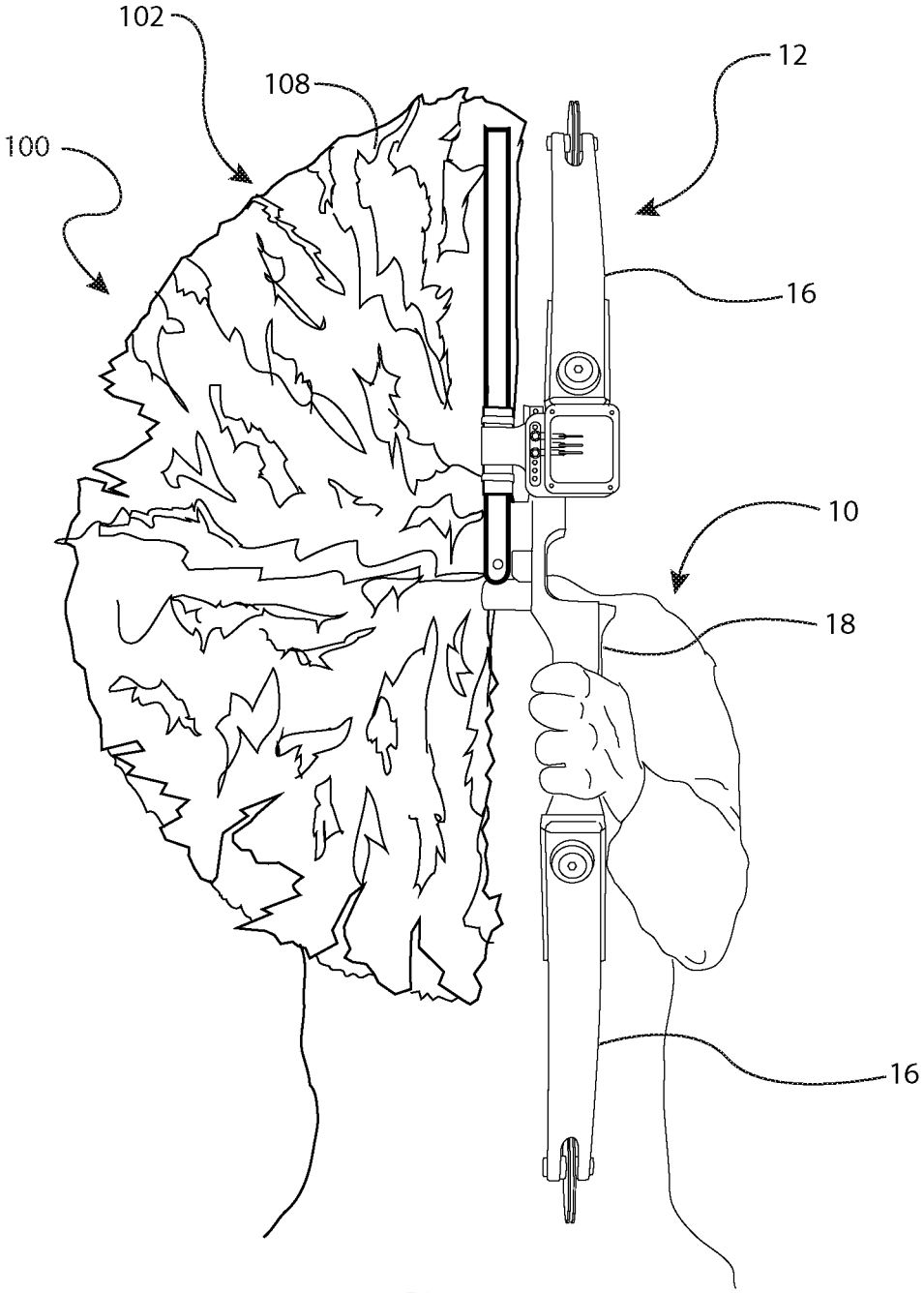
FIG. 1 is an illustrative front elevation view of a version of the application shown while attached to an archery bow as utilized by a hunter out in the field.
Figure 2:
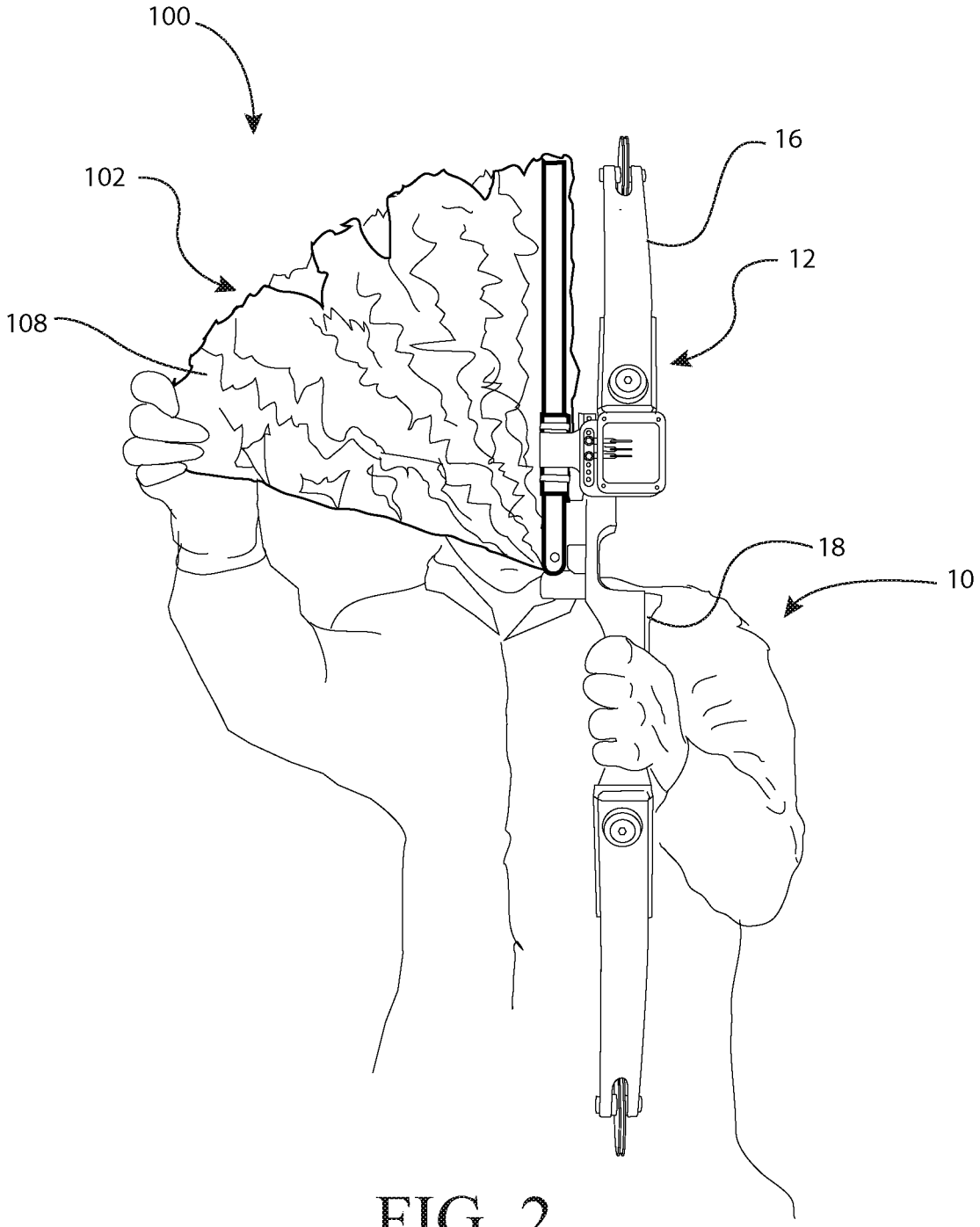
FIG. 2 is an illustrative front elevation view of the version shown in FIG. 1, shown when in the partially contracted position.

Referring now to the figures wherein the showings are for purposes of illustrating a preferred version of the invention only and not for purposes of limiting the same, the present application discloses a bow blind 100 that is attachably removable from an archery bow 12. The bow blind 100 is preferably configured to expand between a retracted position and an unfurled position. FIG. 1 and FIG. 2 show an environmental view of a hunter 10 holding an archery bow 12 that has a version of the bow blind 100 attached thereto. The bow blind 100 is illustrated in an unfurled position, which provides camouflage for the hunter 10 as the hunter draws the bowstring 14 while hunting game.

The archery bow 12 may be a compound bow, a recurve bow, a long bow, a crossbow, and the like. The archery bow 12 may include a handle 18 or bow riser, a bow limb 16 extending from each end of the handle 18, and a bowstring 14 attached to each outer end of the bow limbs 16. The archery bow 12 is configured to shoot an arrow in response to the hunter 10 pulling the string 14 of the archery bow 100, with the arrow attached thereto, relative to the handle 18 and bow limbs 16, and releasing the bowstring 14.

By way of background, when hunting for game, such as deer, turkey, and the like, it is common for the hunt to be ruined as a result of the game catching a glimpse of the hunter 10 as they draw their bowstring 14 back. The bow blind 100 is configured to disguise the hunter 10 drawing their bowstring 14 back in order to prevent the game from seeing the drawing action by the hunter 10. The bow blind 100 is configured to be lightweight and easy to use, such that operation of the bow blind 100 by the hunter 10 is quick and quiet. The bow blind 100 is also configured to be weatherproof and detachable from the archery bow 12.

Figure 12:
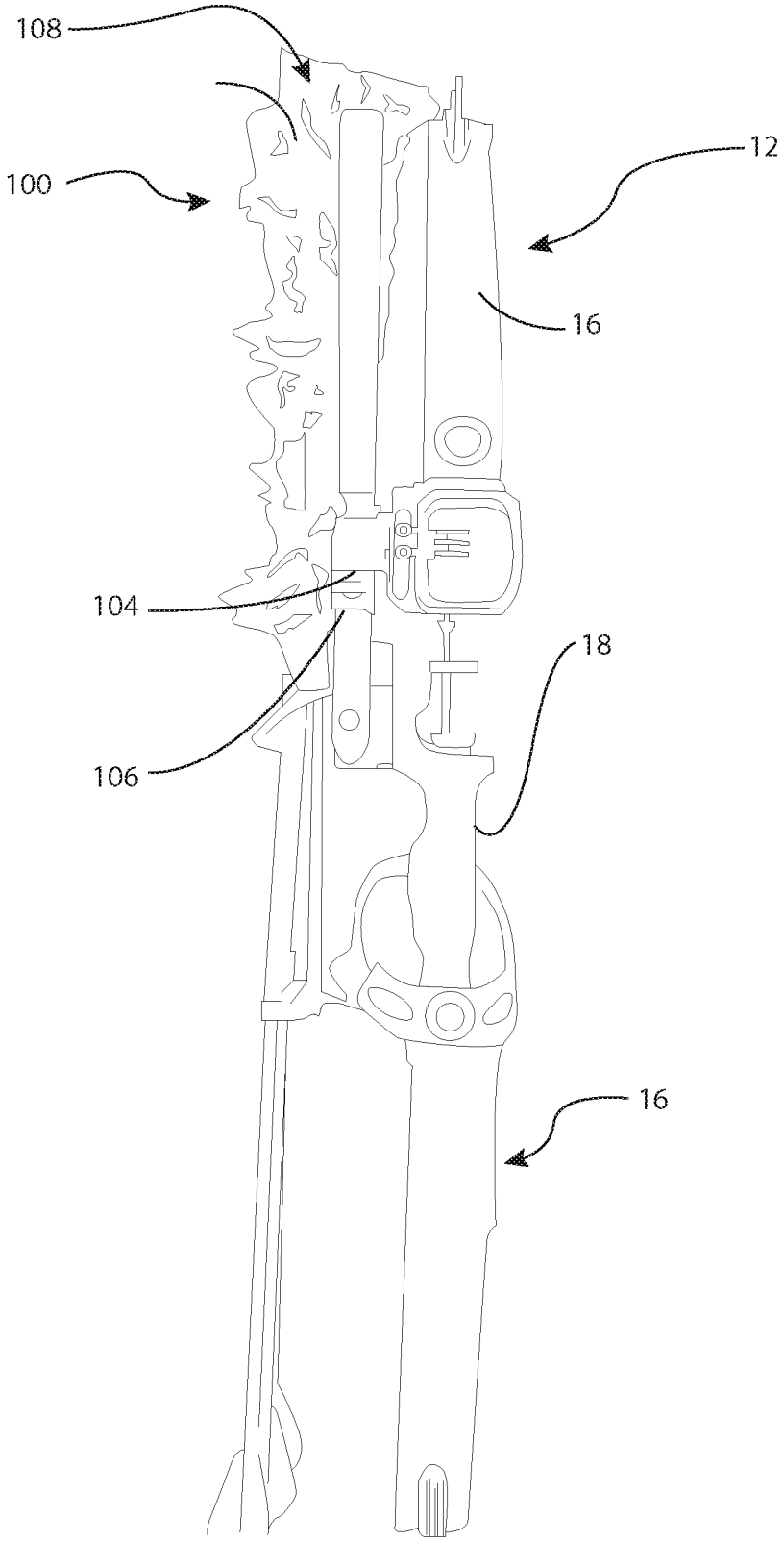
FIG. 12 is an illustrative perspective front view of a version of the application shown when attached to the sight mount of an archery bow, with the fan portion in the retracted position.
Figure 13:
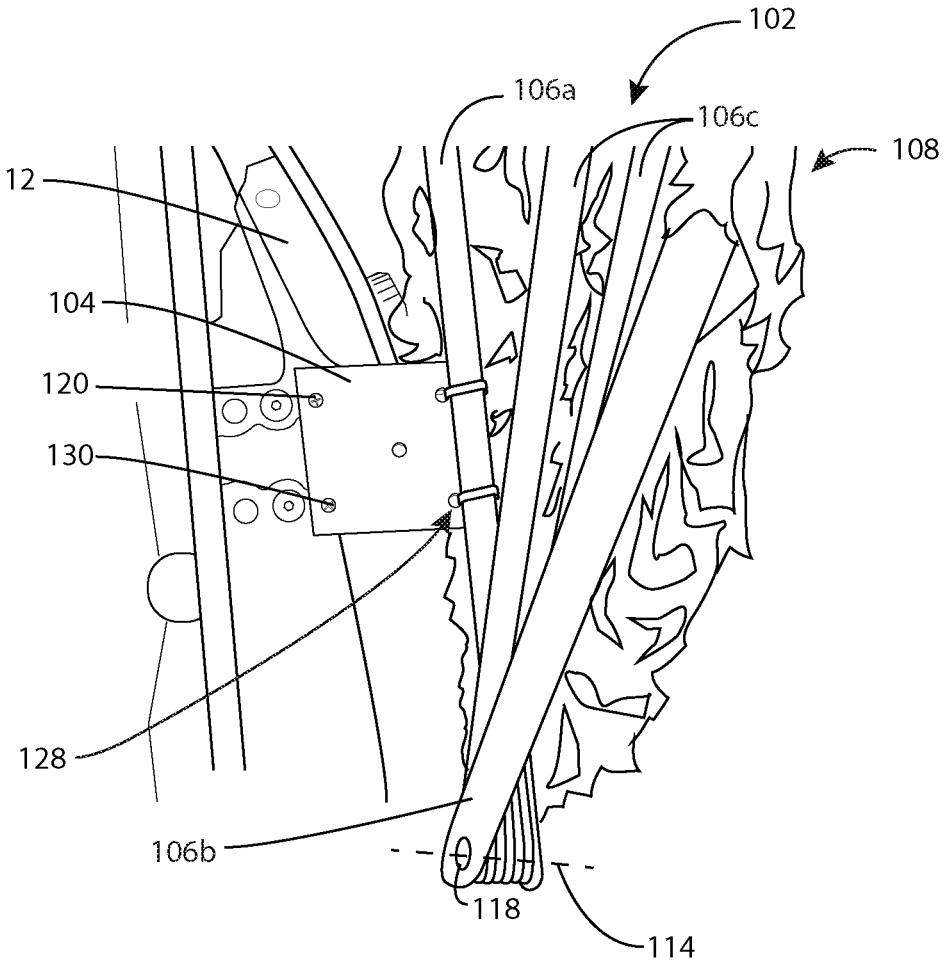
FIG. 13 is an illustrative perspective side view of a version of the application shown when in a partially retracted position.
Figure 14:
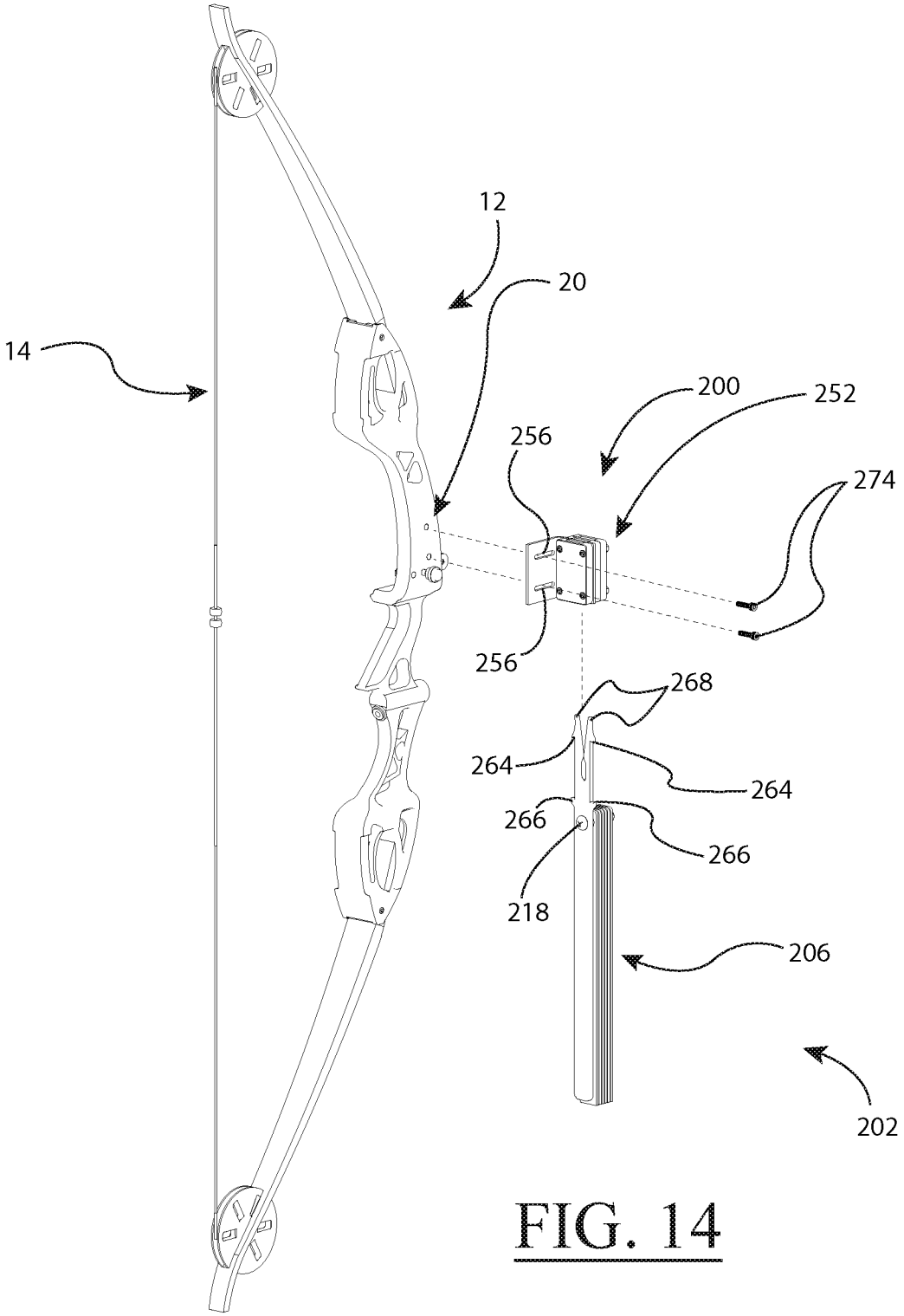
FIG. 14 is a perspective view of a version of the bow blind shown when detached from an example hunting bow.
Figure 15:
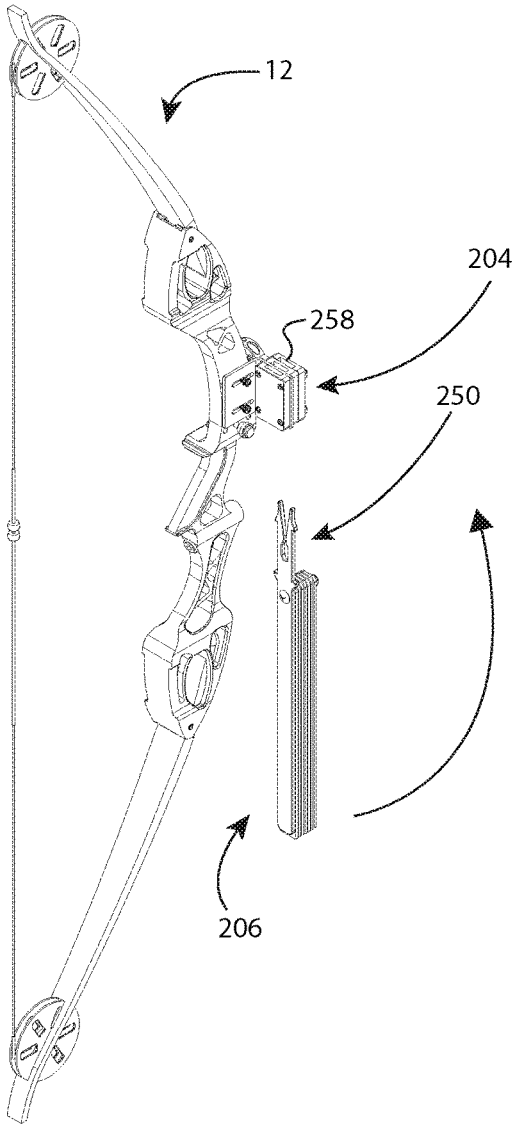
FIG. 15 is a perspective view of a version of the bow blind showing the mounting bracket assembly attached to the sight mount of an archery bow and a fan portion that is detached therefrom.
Figure 16:
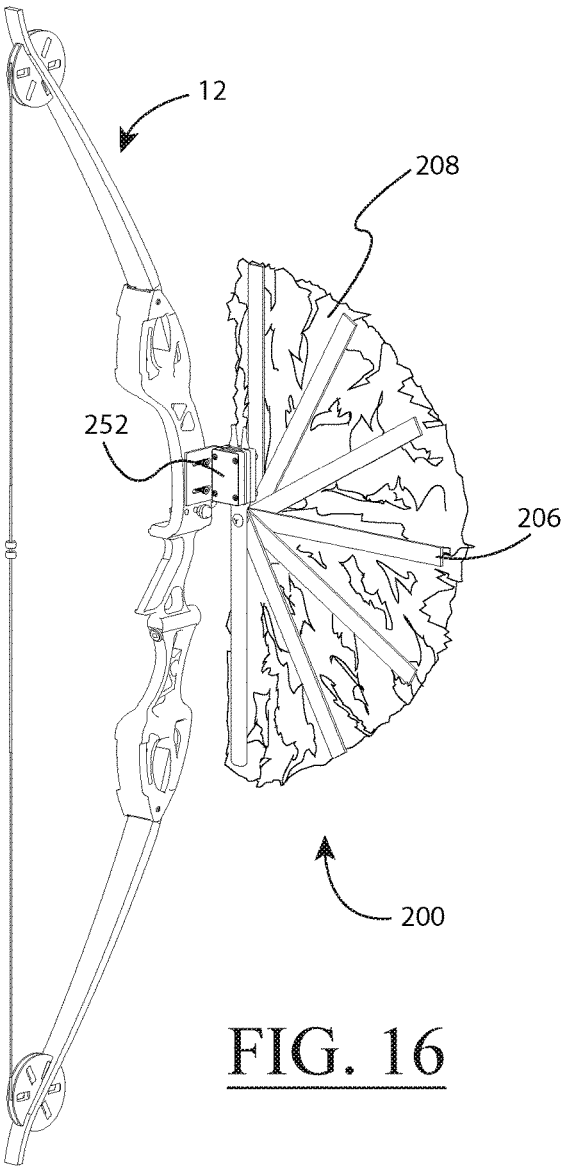
FIG. 16 is a perspective view of a version of the bow blind shown when attached to an example hunting or archery bow.
Figure 17:
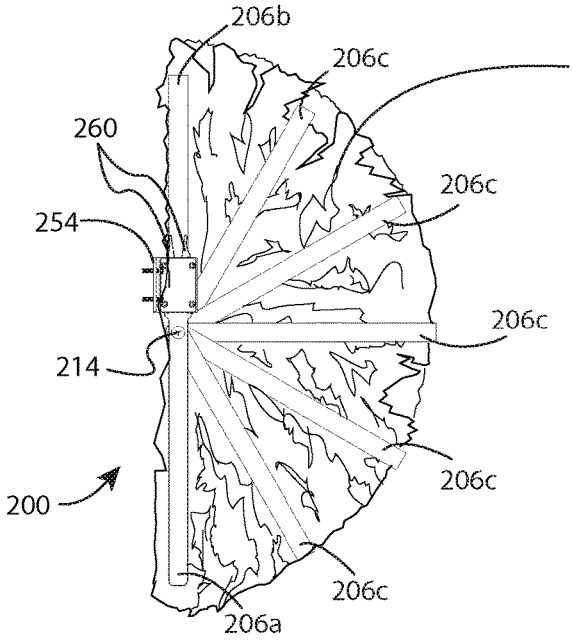
FIG. 17 is a rear elevation view of a version of the application shown when in the expanded position.
Figure 18:
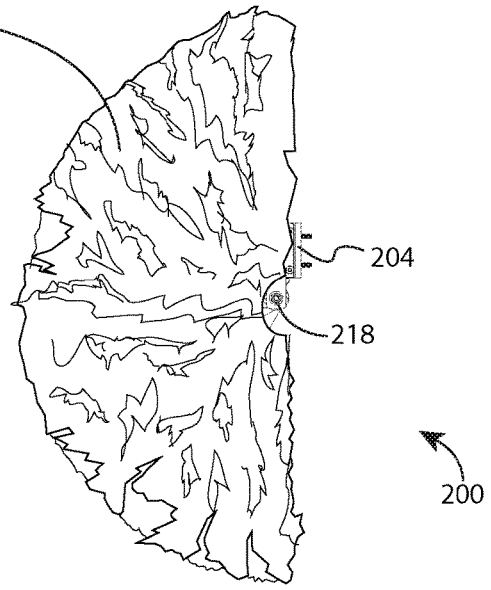
FIG. 18 is a front elevation view of the version shown in FIG. 17.
Figure 19:
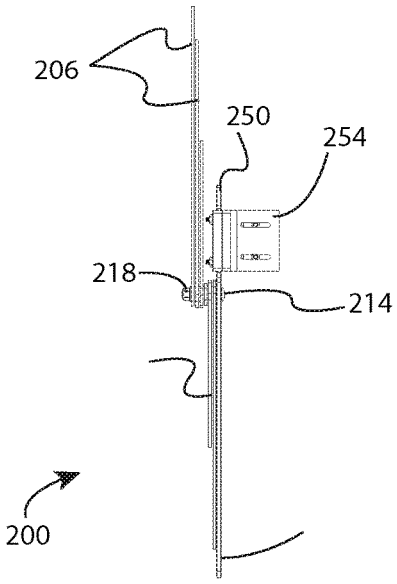
FIG. 19 is a left-side elevation view of the plurality of spokes affixed to the mounting assembly.
Figure 20:
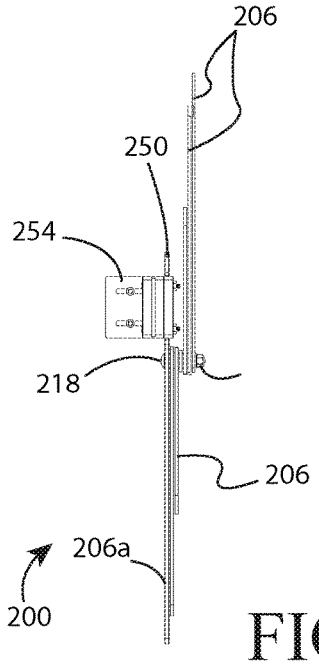
FIG. 20 is a right-side elevation view of the plurality of spokes affixed to the mounting assembly of the version shown in FIG. 19.
Figure 21:
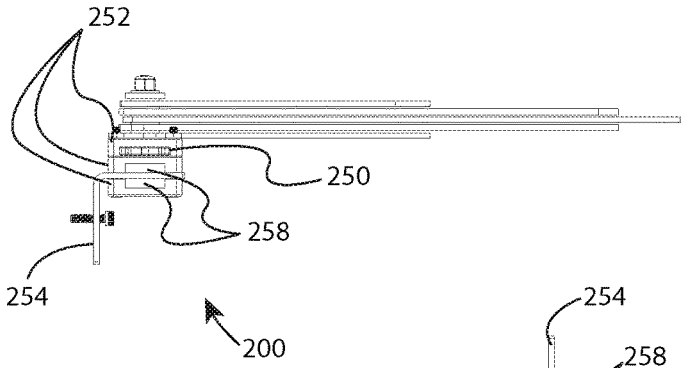
FIG. 21 is a top plan view of the plurality of spokes affixed to the mounting assembly of the version shown in FIG. 19.
Figure 22:
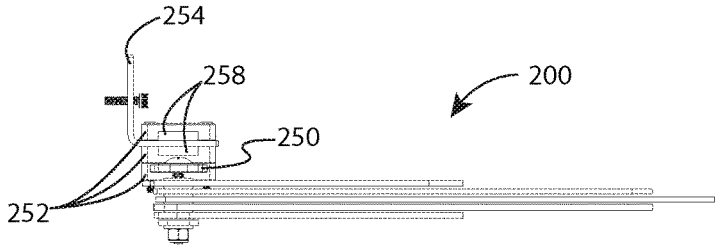
FIG. 22 is a bottom plan view of the plurality of spokes affixed to the mounting assembly of the version shown in FIG. 19.
Figure 23:
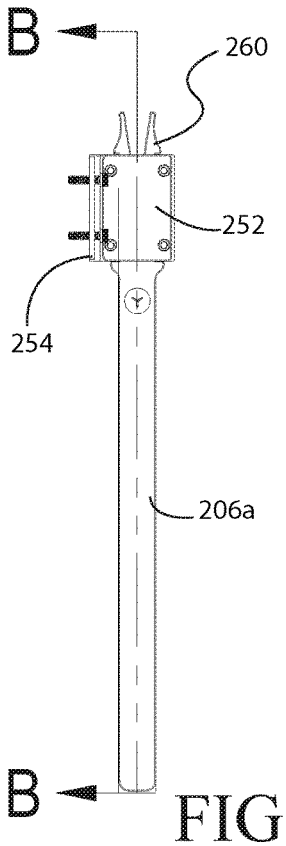
FIG. 23 is a rear elevation view of the plurality of spokes affixed to the mounting assembly when in a retracted position.
Figure 24:
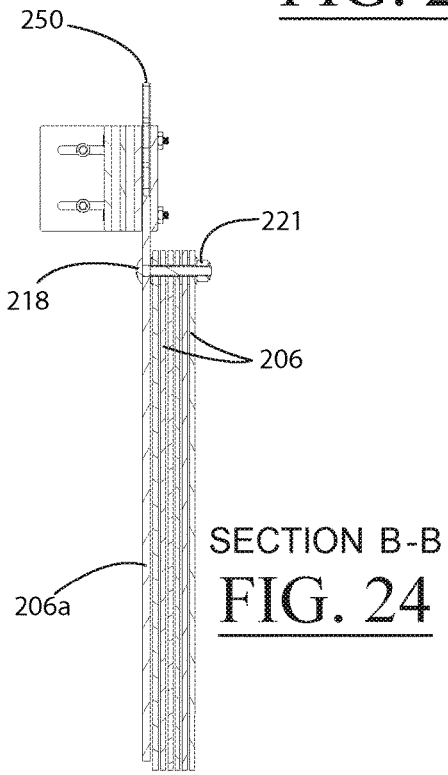
FIG. 24 is a right-side cross-sectional view taken along lines B-B of FIG. 23.
Figure 25:
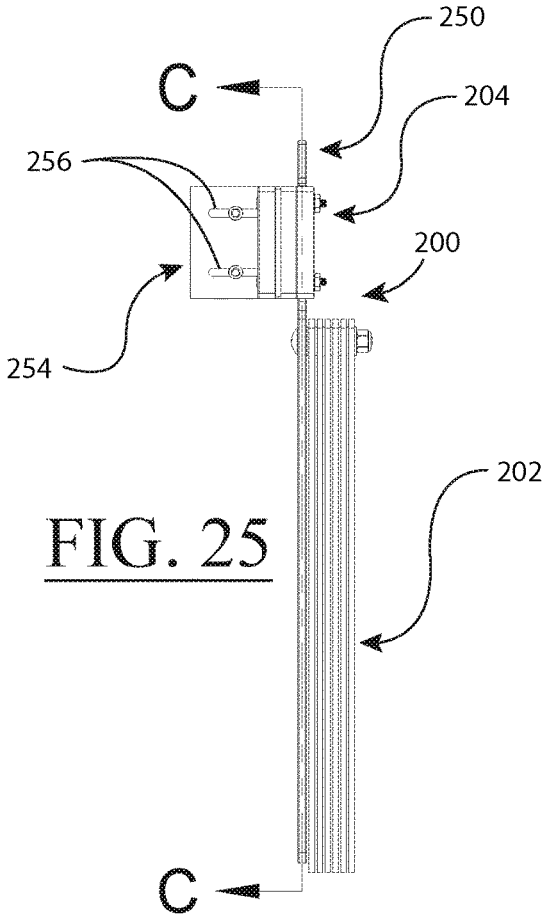
FIG. 25 is a right-side elevation view of the plurality of spokes affixed to the mounting assembly when in the retracted position.
Figure 26:
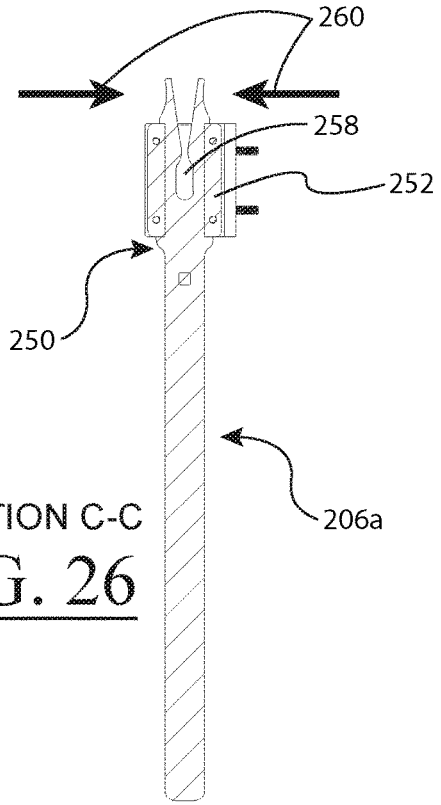
FIG. 26 is a cross-sectional view taken along lines C-C of FIG. 25.

The bow blind 100 is configured to radially expand from a linear, uniform profile to an expanded semi-circular profile, resembling a folding hand fan, and is configured for attachment to a side of the archery bow 12. For example, the bow blind 100 is configured to be moved by the hunter 10 between a retracted position (See FIG. 2 and FIG. 12) and an unfurled position (See FIG. 1). When in the unfurled position, the bow blind 100 creates a radial visual barrier, thereby concealing the drawing movement (pulling back the string 14) of the hunter 10. This allows the hunter 10 to draw the archery bow 12 without the game being spooked, seeing the movement. When not in use, the bow blind 100 folds up neatly to the retracted position, such that the bow blind 100 is parallel with the bow limbs 16 positioned beside the quiver (See FIG. 12).

In a first version of the application, with reference to FIG. 3-FIG. 6, the bow blind 100 is shown detached from the archery bow 12, in the unfurled position. The bow blind 100 generally includes a radially expanding fan portion 102 and a mounting bracket 104 attached to the fan portion 102. With specific reference to FIG. 3, the fan portion 102 includes a first outer spoke **106*a*, a second outer spoke 106*b*, and a plurality of inner spokes 106*c* (collectively referred to as 106), with the plurality of inner spokes 106*c* sandwiched between the first outer spoke 106*a* and the second outer spoke 106*b*. The fan portion 102 also includes a flexible, sheet-like material 108, operatively attached to the spokes 106**, as will be explained in more detail below.

Figure 3:
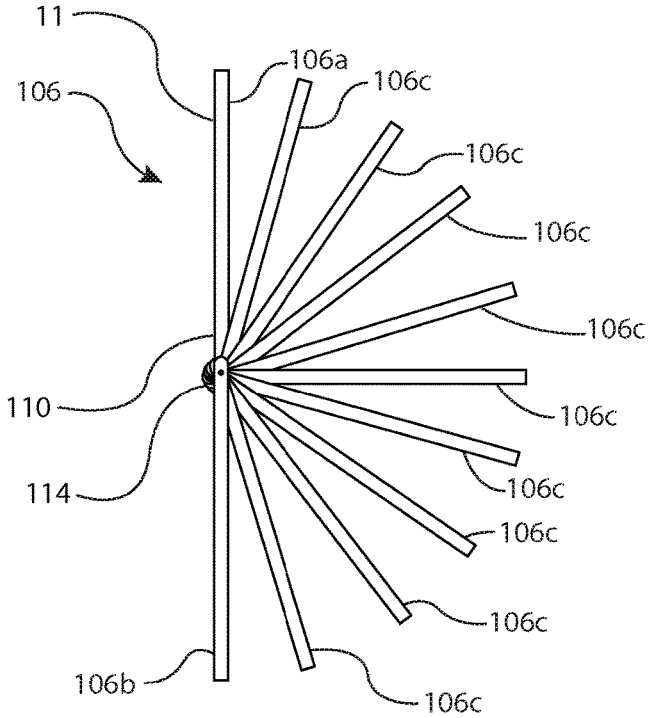
FIG. 3 is a rear elevation view of the plurality of spokes shown without the flexible material.
Figure 4:
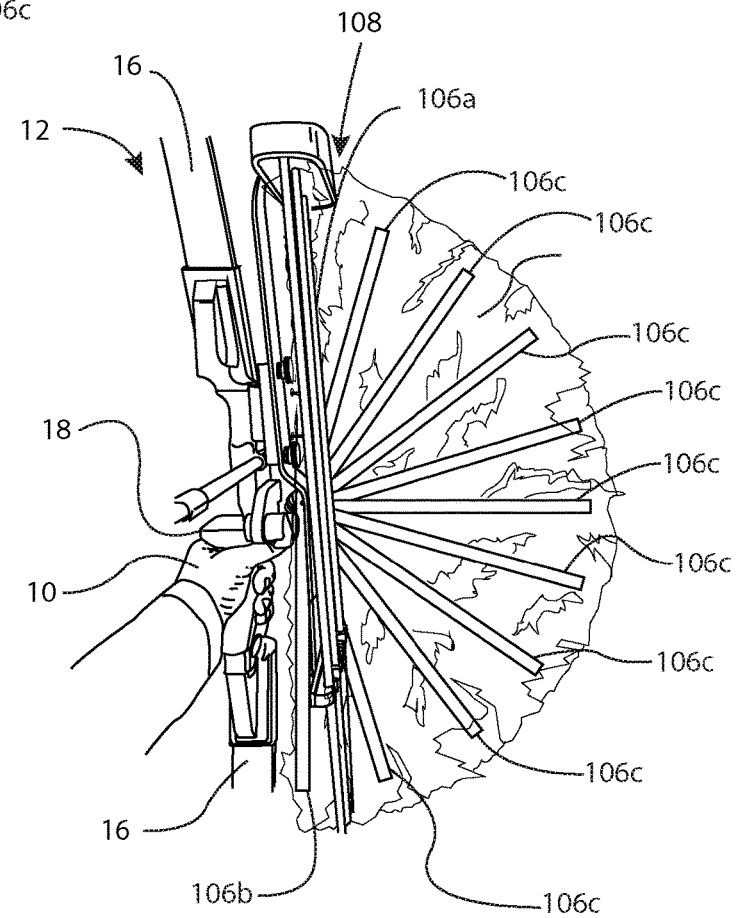
FIG. 4 is an illustrative rear-perspective view of a version of the application shown in the expanded position while attached to an archery bow.
Figure 5:
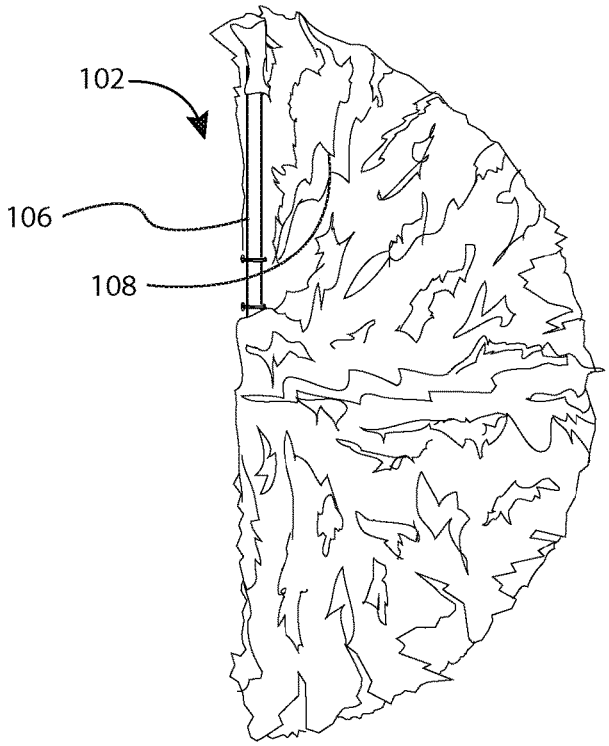
FIG. 5 is a front elevation view of the fan portion shown when in the expanded position.

Referring again to FIG. 3, the spokes 106 may be made of rigid or semi-rigid materials such as metal and various metal alloys, plastics, polymers in various forms, composite materials, wood, and/or the like. In the illustrated version, each spoke 106 has an elongated shape, resembling a blade, comprising a proximal end 110 and a distal end 112. The spokes 106 are pivotally connected to one another at a pivot axis 114 that is positioned near the proximal end 110. In one non-limiting example, the spokes 106 define a pivot hole 116, near the proximal end 110, with the pivot holes 116 aligned with one another along the pivot axis 114. With reference to FIG. 3, a rod 118 or bolt may extend along the pivot axis 114, through the pivot holes 116, to pivotally interconnect the spokes 106 as they pivot relative to one another about the pivot axis 114, which is stationary by virtue of the attachment of the bow blind 100 to the archery bow 12.

Referring again to FIGS. 4-6, a length of the spoke 106 may define a radius of the bow blind 100, when in the unfurled position. When the bow blind 100 is in the unfurled position, a combination of the radius and an arcuate spacing of the distal ends 112 of the spokes 106 from one another define an area to be camouflaged or otherwise obscured by the flexible material 108 in the unfurled position. The bow blind 100 is configured such that the spokes 106 pivot about the pivot axis 114 an amount that is sufficient to provide camouflage to an area that is arcuate in shape and may not be a full circle; however, other embodiments may encompass a complete circular profile.

The spokes 106 are covered by the flexible material 108, which is foldable. The flexible material 108 may include, but should not be limited to, fabric, man-made fiber, cotton, and the like. The flexible material 108 is operatively attached to each spoke 106, in order to limit the arcuate spacing between each of the second ends 112 when the bow blind 100 is in the unfurled position. The flexible material 108 may have designs imprinted thereon. The designs may include, but should not be limited to, camouflage designs. The flexible material 108 may be configured as a screen to allow air to flow through while allowing the hunter 10 to see the game during a hunt.

Figure 6:
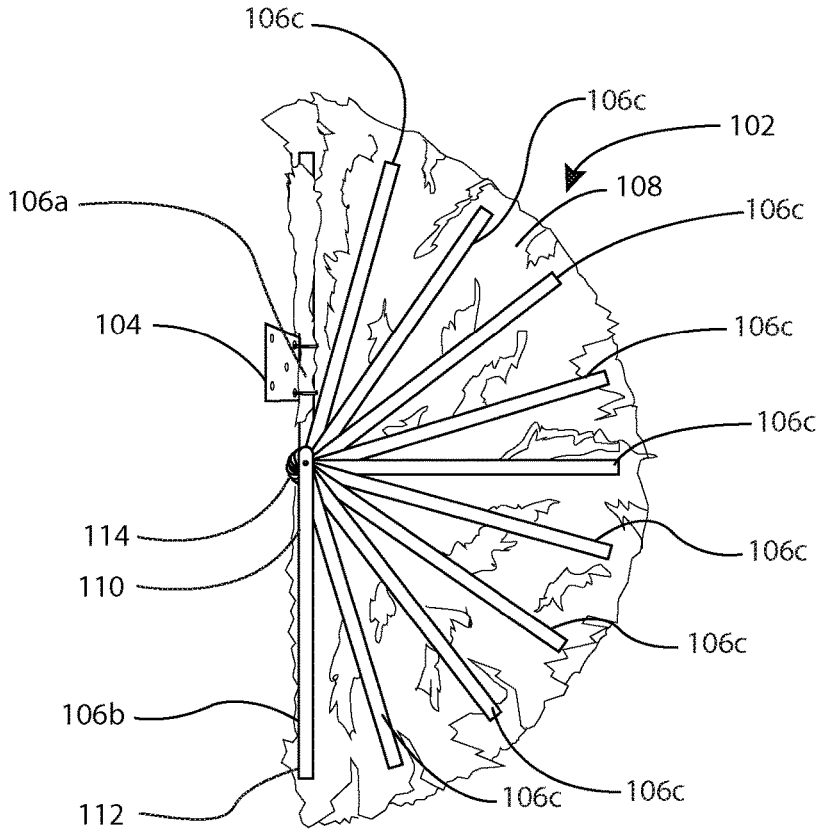
FIG. 6 is a rear elevation view of the fan portion shown when in the unfurled position.
Figure 7:
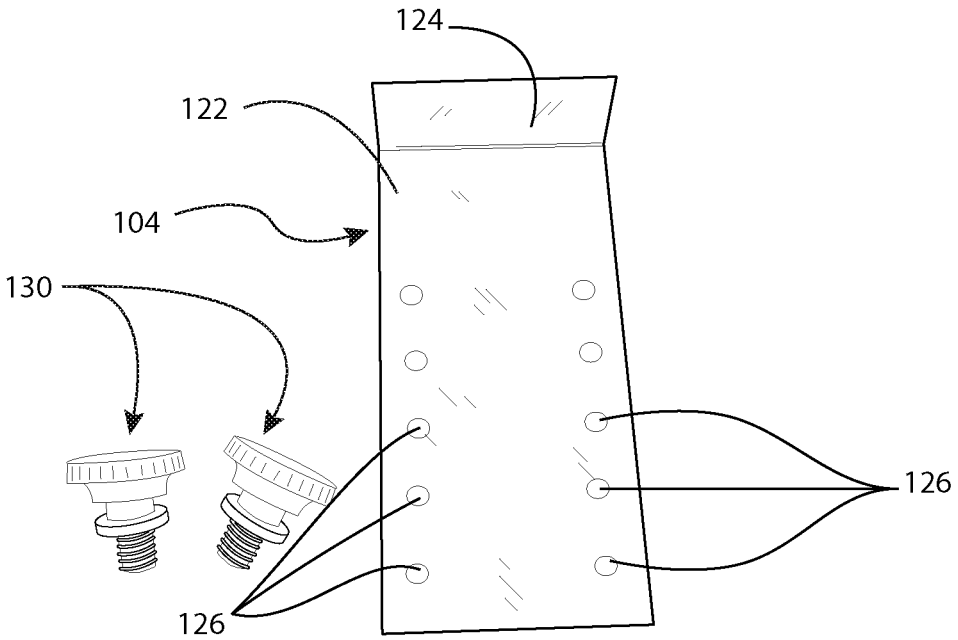
FIG. 7 is a perspective view of a version of the mounting bracket assembly for attachment to a sight mount of an archery bow.
Figure 8:
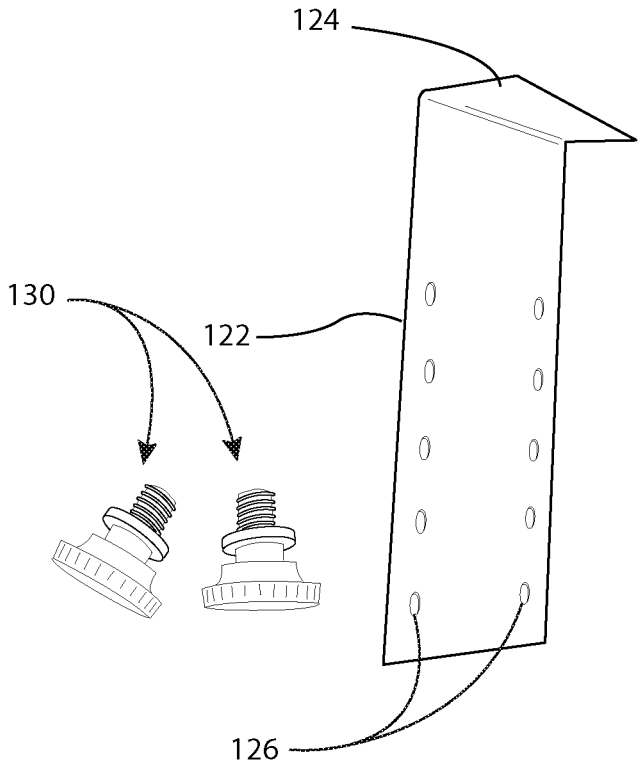
FIG. 8 is a perspective view of a version of the mounting bracket assembly for attachment to a sight mount of an archery bow.

With reference to FIG. 6, the mounting bracket assembly 104 is configured for attachment to the archery bow 12 for use while hunting game. The mounting bracket assembly 104 is operatively attached to at least one of the plurality of spokes 106. More specifically, in a version, the mounting bracket assembly 104 is operatively attached to the first outer spoke 106*a*.

Figure 9:
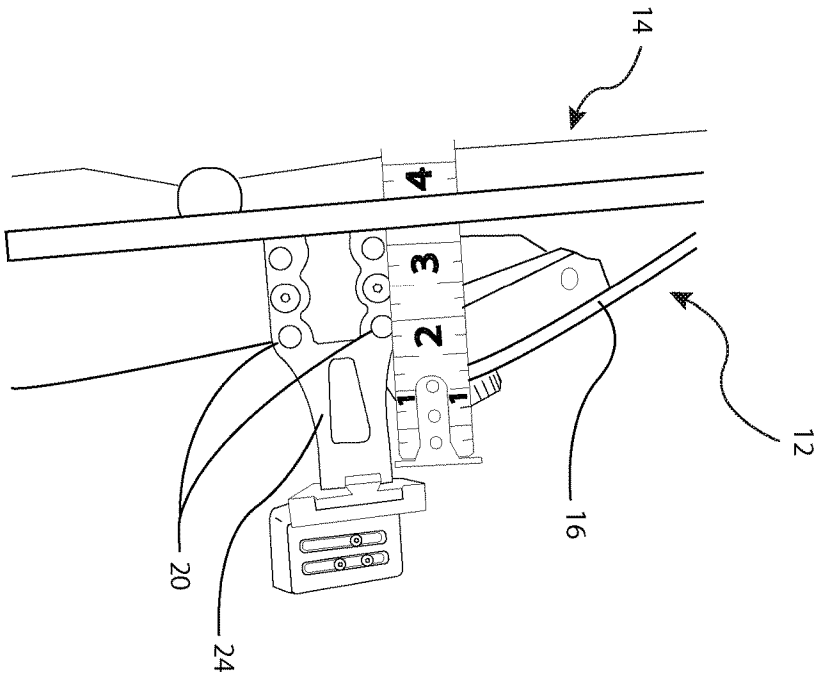
FIG. 9 is an up-close perspective view of an example archery hunting bow sight mount.
Figure 10:
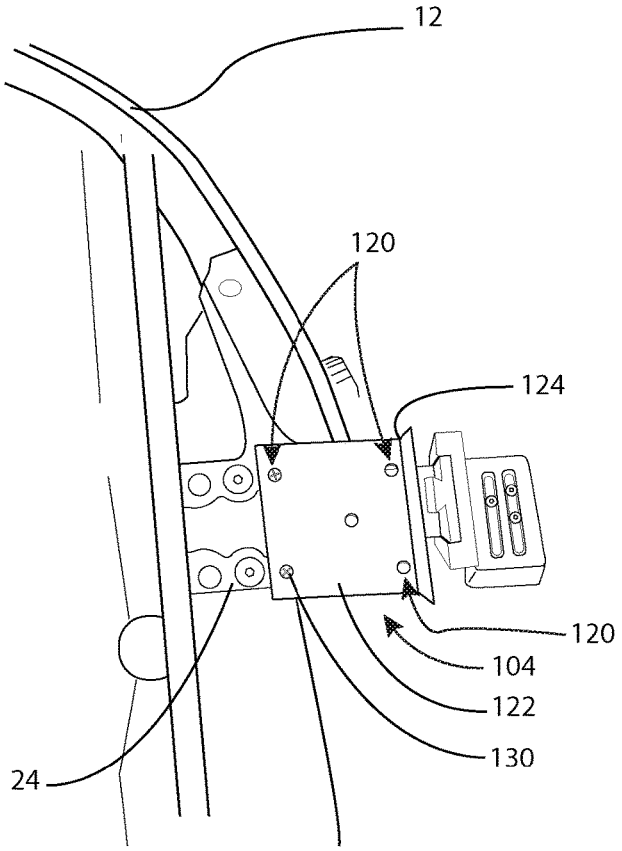
FIG. 10 is an up-close perspective view of the mounting assembly attached to the sight mount shown in FIG. 9.
Figure 11:
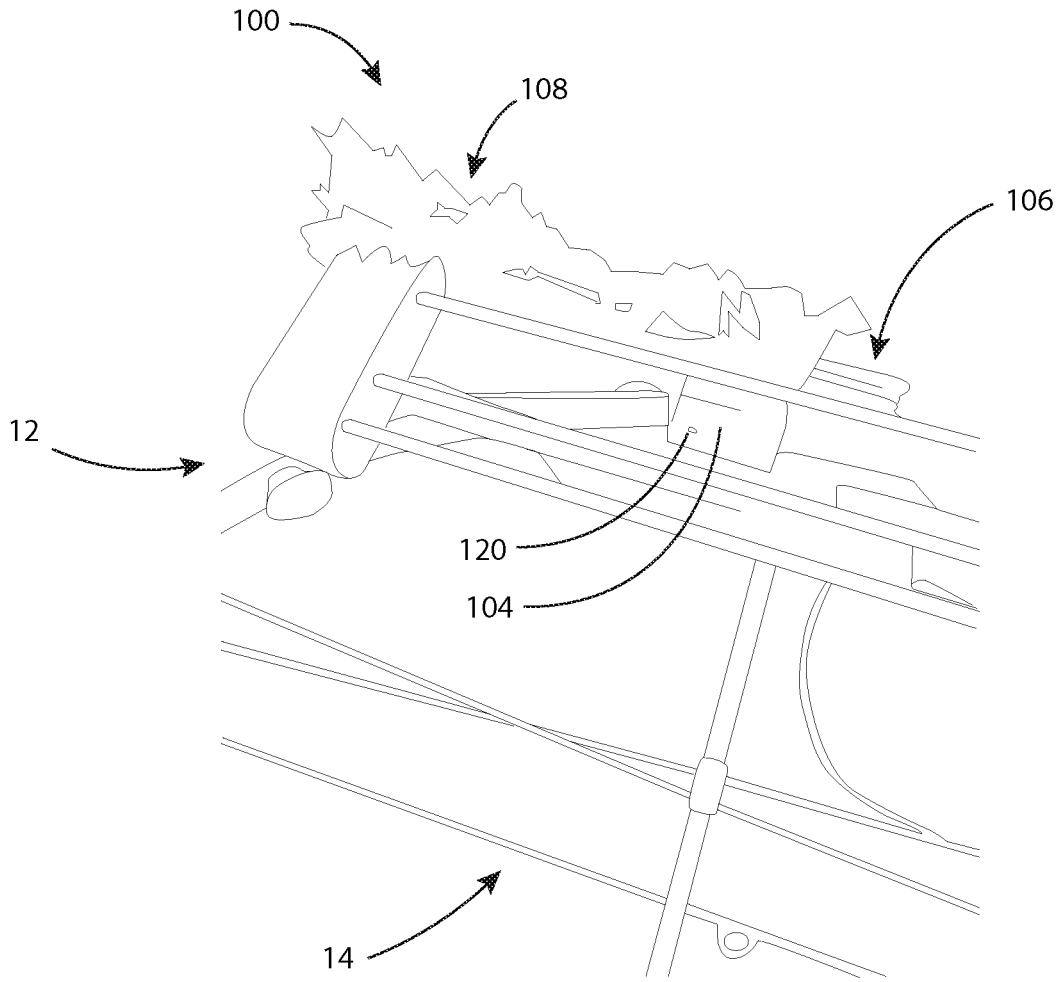
FIG. 11 is an illustrative perspective side view of a version of the application shown when attached to the sight mount of the archery bow, with the fan portion in the retracted position.

Referring to FIGS. 7-10, an example mounting bracket assembly 104 is shown. Referring specifically to FIGS. 9-10, the mounting bracket assembly 104 is configured for attachment to the archery bow 12 sight mount 22. More specifically, the mounting bracket assembly 104 defines at least two pairs of mounting holes 120. The bow handle 18, or riser, of the archery bow 12 provides a sight mount 22 defining one pair of receiver holes 20. The spacing of the pairs of mounting holes 120 and the receiver holes 20 are enunciated in an industry-standard set forth by the Archery Trade Association of Salt Lake City, Utah. The sight mount is attached to the bow handle 18, or riser, of the archery bow 12 by one or more screws 130 that extend through one pair of the mounting holes 120 of the mounting bracket assembly 104 and the corresponding pair of receiver holes 20 of the archery bow 12.

The mounting bracket assembly 104 may be formed from a single piece of material as an L-shaped 104. The mounting bracket 104 includes a first leg 122 and a second leg 124. The second leg 124 extends from the first leg 122 to define an angle therebetween. The angle is configured to facilitate the fit of the fan portion 102 of the bow blind 100 relative to the sight mount 22 of the archery bow 12. In one non-limiting example, the first leg 122 and the second leg 124 may extend in a generally perpendicular relationship to one another, such that the angle 39 is 90 degrees. The first leg 122 defines at least one pair of openings 126 (hereinafter opening pair). In one non-limiting embodiment, the first leg 122 defines a plurality of opening pairs 126, disposed in spaced apart relationship to one another. Each opening pair 126 is spaced apart from one another to conform to the industry standard, as discussed above. As such, each opening pair 126 will align with a pair of receiver holes 20 of the sight mount 22 to allow the mounting bracket 104 to be fastened thereto. Since these attachment holes are standard on all makes of bows, the mounting holes 120 for the sight mounts 24 are also standard. Therefore, no additional holes need to be formed in the mounting bracket 104 in order to install the bow blind 100 to the archery bow 12.

The second leg 124 of the mounting bracket 104 may be configured to facilitate attachment of the mounting bracket 104 to the first outer spoke 106*a* of the fan portion 102 of the bow blind 100. In one non-limiting example, the second leg 124 defines at least one hole 132, such that a cable tie 128 extends through therethrough and around the first outer spoke 102*a* to secure the fan portion 102 to the mounting bracket 104.

With continuing reference to FIGS. 7-10, the mounting bracket 104 is preferably rigid and may be formed from suitable materials such as metal and various metal alloys, plastics, polymers in various forms, and composite materials. The mounting bracket 104 is preferably made from a material suitable to support the torque associated with opening and closing the blind relative to the bow. When the mounting bracket 104 is formed from metal, the metal may be formed from galvanized sheet metal, stainless steel, and the like. The mounting bracket 104 may be powder-coated.

The mounting bracket 104 may further include an attachment and release mechanism 274 that is configured to provide quick and simple attachment to and detachment from the archery bow 12. The attachment may include, but should not be limited to, a dovetail fitting, screw knobs, cable ties, and/or the like. In one non-limiting example, the mounting bracket assembly 104 is formed from a composite material and is configured with a dovetail disconnect.

Now, with reference to FIG. 14-FIG. 34, a second version of the application is directed toward a quick-release type bow blind 200 that provides the ability to quickly attach and detach the bow blind 200 from an archery bow 12. The bow blind version 200 is portable and generally comprises a radially expanding fan portion 202 that is both attachable to and detachable from a mounting bracket assembly 204 that is affixed to the archery bow 12. In the illustrated version, the bow blind 200 may further include a connection member 250 that provides a release mechanism 274 and is configured to easily attach and detach from the mounting bracket assembly 204.

Referring to FIGS. 17-28, the radially expanding fan portion 202 comprises a plurality of spokes 206 that pivot about a pivot axis 214 via a bolt 218. Specifically, similar to the first embodiment 100 previously disclosed, the fan portion 202 includes a first outer spoke 206*a*, a second outer spoke 206*b*, and a plurality of inner spokes 206*c* (collectively referred to as 206), with the plurality of inner spokes 206*c* sandwiched between the first outer spoke 206*a* and the second outer spoke 206*b*. The fan portion 202 also includes a flexible, sheet-like material 208, operatively attached to the spokes 206. In the version, spacer washers 219 and tensioning nut 221 are used to control the case of expanding and retracting the fan portion 202 (See FIG. 28)

In the version, the flexible material 208 is affixed, for example, by glue, to each spoke 206 individually, forming a semi-circle or arcuate profile when the fan portion 202 is unfurled. The flexible material 208 may include, but should not be limited to, fabric, man-made fiber, cotton, and the like. The flexible material 208 is operatively attached to each spoke 206, in order to limit the arcuate spacing between each of the second ends 212 when the bow blind 200 is in the unfurled position. The flexible material 208 may have designs imprinted thereon. The designs may include, but should not be limited to, camouflage designs.

Figure 29:
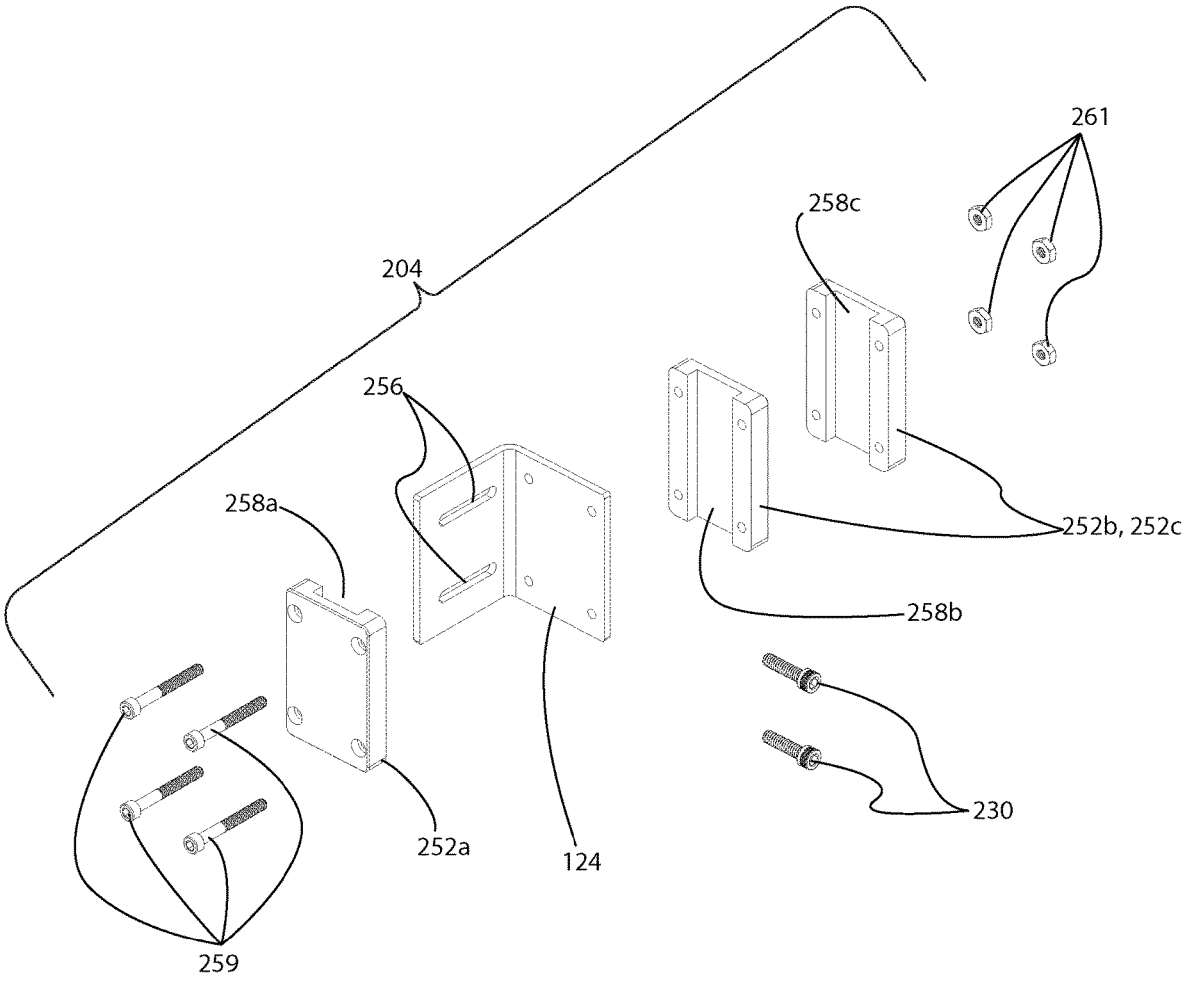
FIG. 29 is an exploded view of a version of the mounting bracket assembly.
Figure 30:
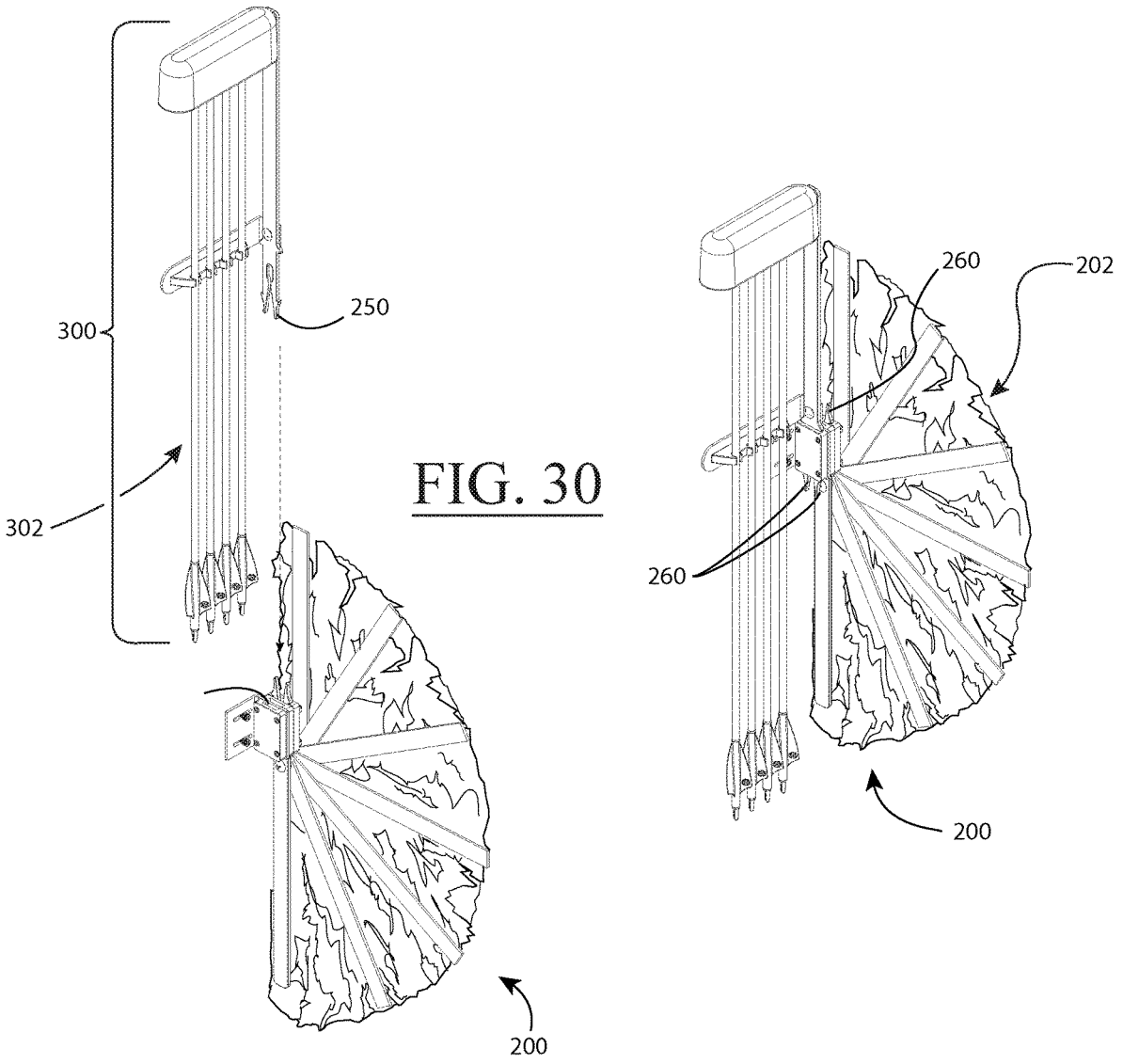
FIG. 30 is an illustrative perspective view showing a version of the application configured to receive the attachment of a quiver of arrows via a connection member to the mounting bracket.

As best shown in FIG. 25-FIG. 27, FIG. 29, the mounting bracket assembly 204 for mounting the fan portion 202 to the archery bow 12 includes a slotted mounting block 252 and a sub-bracket 254 extending from the side of the slotted mounting block 252, defining an angle therebetween. Preferably, the slotted mounting block 252 and the sub-bracket 254 form an L-shape or define a right angle therebetween. The sub-bracket 254 defines a pair of openings 256 that are spaced apart to correspond and align with a pair of standard-sized sight mount receiver holes 20 of an archery bow 12. Thus, the mounting bracket assembly 204 can be attachable to an archery bow 12 by way of one or more screws 274 or other fasteners (See FIG. 29 for details). As shown in FIG. 29, the pair of openings 256 may be in the form of horizontal slots to allow for horizontal adjustment of the bow blind 200.

Figure 27:
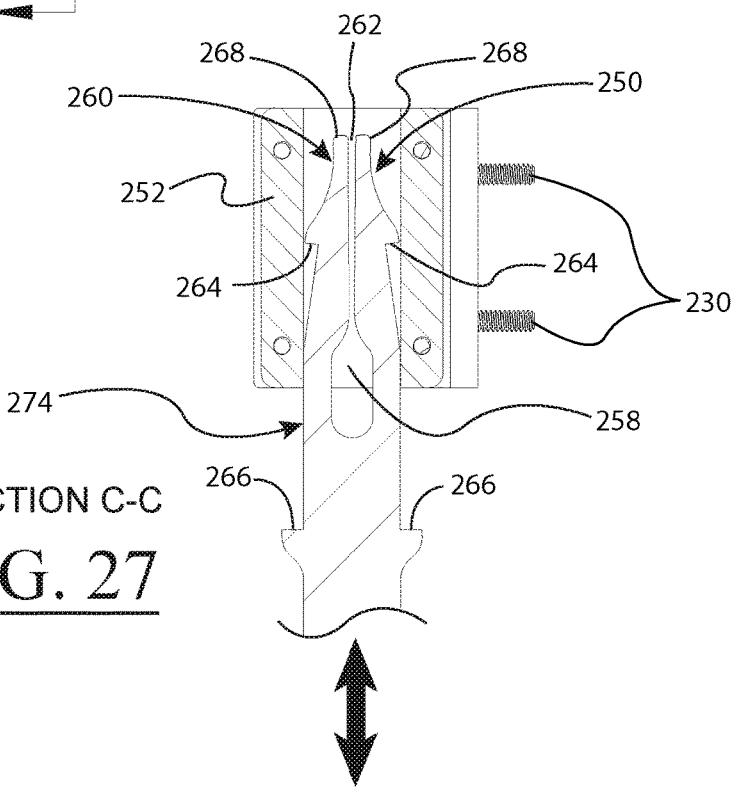
FIG. 27 is an up-close cross-sectional view of the connection member partially inserted into the slotted mounting block taken along lines C-C of FIG. 25.

In a version of the application, the slotted mounting block 252 is configured to receive and engage with one or more connection members 250, which provides a release mechanism 274. As illustrated in FIG. 27 and FIG. 29, the slotted mounting block 252 includes one or more longitudinal slots 258, extending therethrough, configured to receive and engage with the connection member 250. Preferably, the longitudinal slot 258 extends in a vertical direction while mounted to the archery bow 12. Reciprocally, the connection member 250 generally forms an elongated member that translates into and connects with the longitudinal slot of the slotted mounting block 252.

Figure 31:
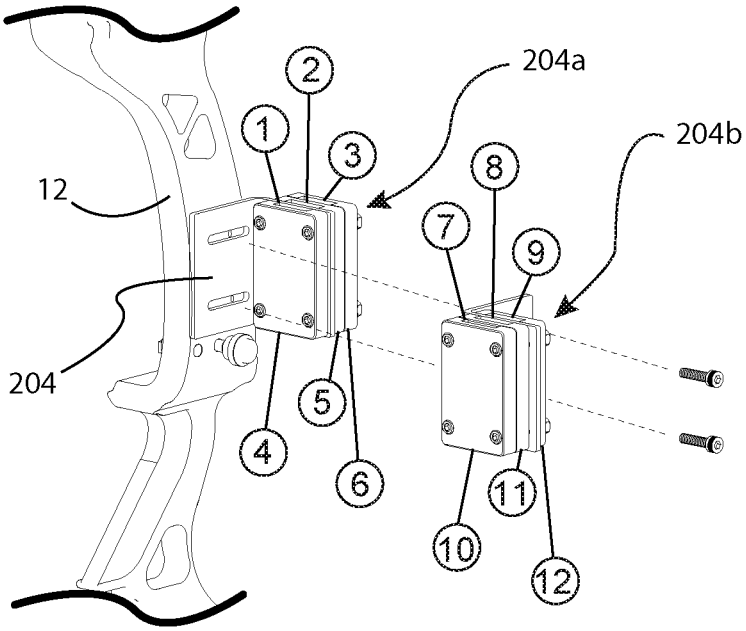
FIG. 31 is an illustrative perspective view of a version of the application showing the attachment of a second mounting bracket assembly for the receipt and support of accessories having a connection member.

Further, as best shown in FIG. 29, the slotted mounting block 252 may include a plurality of consecutive slotted blocks 253*a*, 253*b*, and 253*c* forming a plurality of longitudinal slots 258*a*, 258*b*, and 258*c* that are configured to receive a connection member 250 (See assembled view in FIG. 31). The screws 259 and nuts 261 are utilized to assemble and secure the parts of the slotted mounting block 252 together. Therefore, the plurality of slots 258 provide multiple connection points for accessories having an affixed connection member 250.

As shown in the illustrated version, the connection member 250 defines a release mechanism 274 in the form of a pair of reciprocal squeeze tabs 260 that provide a gap 262 therebetween to allow lateral flexing, temporarily narrowing the width of the connection member 250 in order to squeeze into and through the longitudinal slot 258. Further, each of the reciprocal squeeze tabs 260 includes an inward-angled tip 268 that collectively forms a triangular profile, thereby allowing the connection member to be easily inserted within the longitudinal slot 258.

Preferably, the connection member 250 is configured to lock within the slotted mounting block 252. As illustrated best illustrated by the cross-sectional FIG. 26 and FIG. 27, each reciprocal squeeze tab 260 ideally has an upper flat catch 264 and a lower flat catch 266, which are configured to simultaneously couple with the longitudinal slot 258 when the connection member 250 is fully inserted within the longitudinal slot 258 of the slotted mounting block 252. Essentially, the upper flat catches 264 operate to lock the connection member 250 with the slotted mounting block 252 and the lower flat catches 266 operate to stop the movement of the connection member 250 within the slotted mounting block 252. To detach connection member 250, the pair of reciprocal squeeze tabs 260 is simply squeezed together, and the body of the connection member 250 is pulled out from within the longitudinal slot 258 of the slotted mounting block 252.

Figure 28:
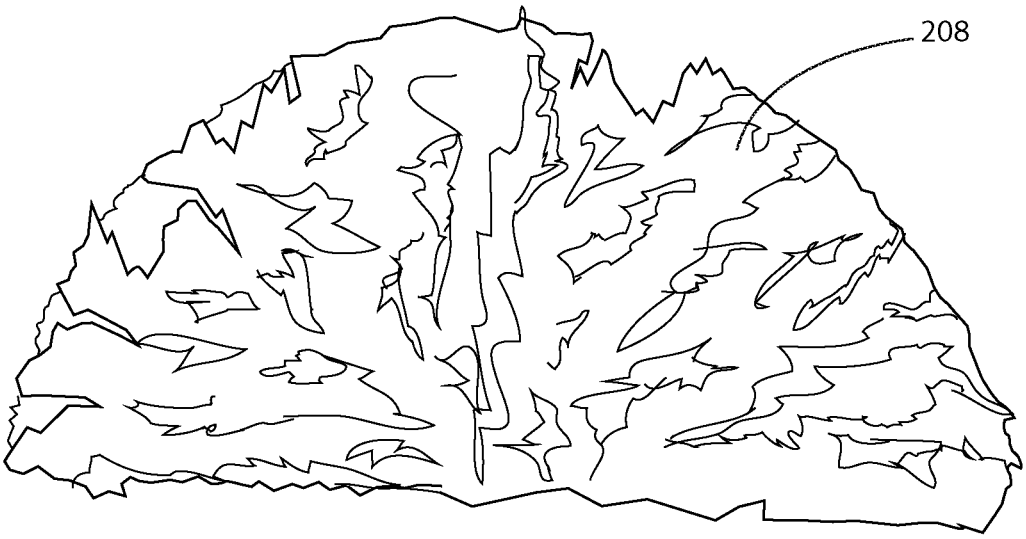
FIG. 28 is an exploded view of a version of the fan portion.
Figure 28:
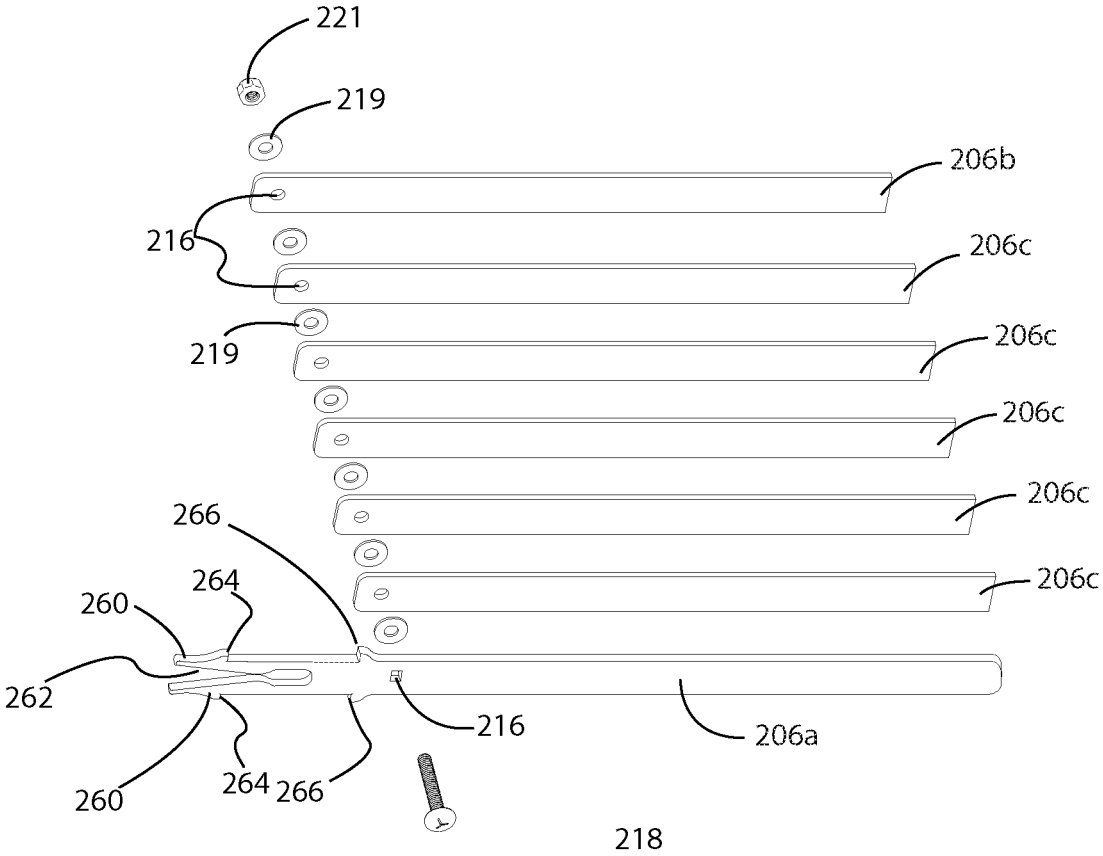

The connection member 250 may be an independent part affixed to the fan portion 202 or to at least one of the spokes 206 and may be rotatably connected via the pivot axis 214. In other versions, the connection member may be integral with or forms a unitary piece with at least one of the spokes 206. As shown in FIG. 28, the connection member is integral with the first outside spoke 206*a*, which radially and linearly extends in the opposite direction from the pivot axis. Thus, preferably, the connection member 250 supports the first outside spoke 206*a* in a vertical manner.

Figure 32:
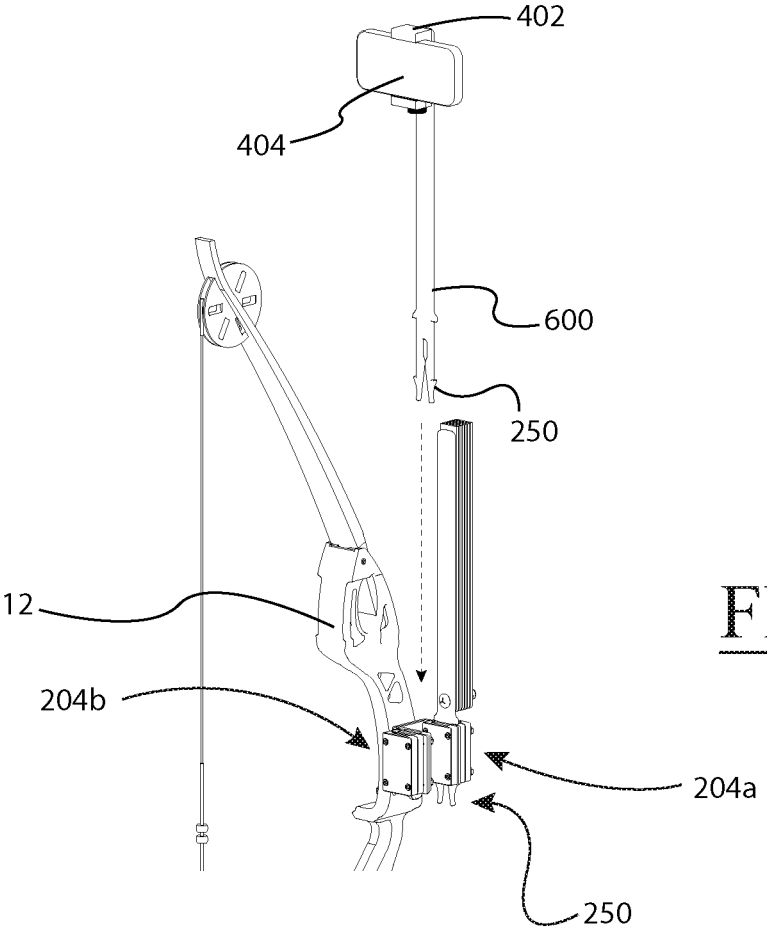
FIG. 32 is an illustrative perspective view of a version of the application providing support for a camera or smartphone device having a connection member.
Figure 33:
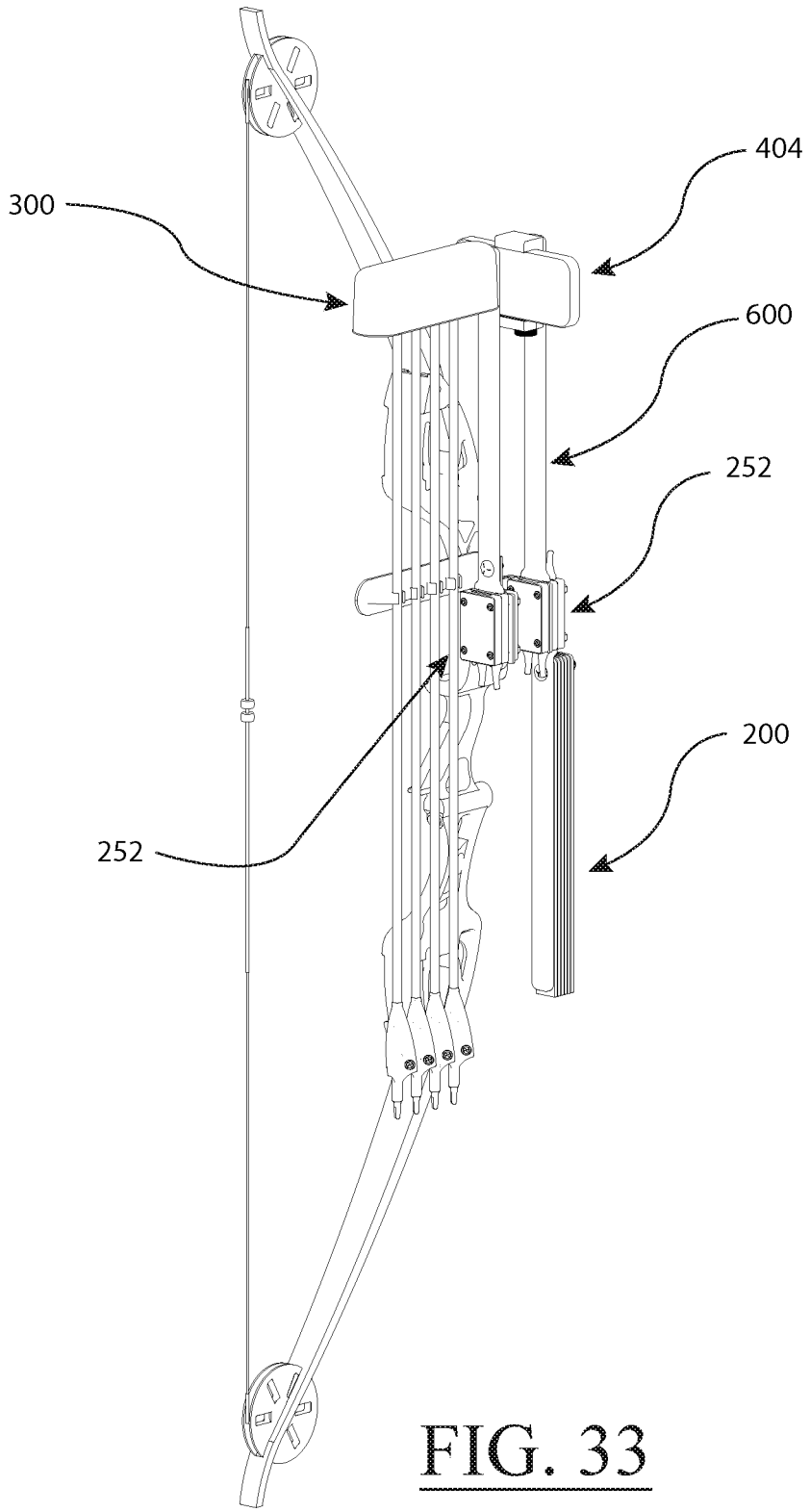
FIG. 33 is an illustrative perspective view of a version of the application that provides support for a plurality of accessories, namely, a camera, smartphone, and/or a quiver of arrows, each having a shaft with a connection member.

As best shown in FIG. 31, additional mounting bracket assemblies 204*a*, 204*b* boasting slotted mounting blocks 252 can be added, providing additional longitudinal slots 258 for receipt of accessories having an affixed connection member 250 with release mechanism 274. In a version as shown in FIG. 32, an accessory support shaft 600 or blade having a first end 602 and a second end 604 is disclosed. The first end 602 defines a connection member 250 having a release mechanism 274 in the form of squeeze tabs 260, and the second end 604 is connected to the accessory, i.e., a spring-loaded smartphone mount 402. Thus, for example as shown in FIG. 32 and FIG. 33, the archery bow 12 can support all of a bow blind 200, a quiver 300 with arrows 302, and a smartphone device 404. This allows for greater versatility and the ability to accessorize the archery bow 12 with multiple devices simultaneously. The camera mount may have a spring-loaded camera grab mount 402 for securing a camera or smartphone 404.

Figure 34:
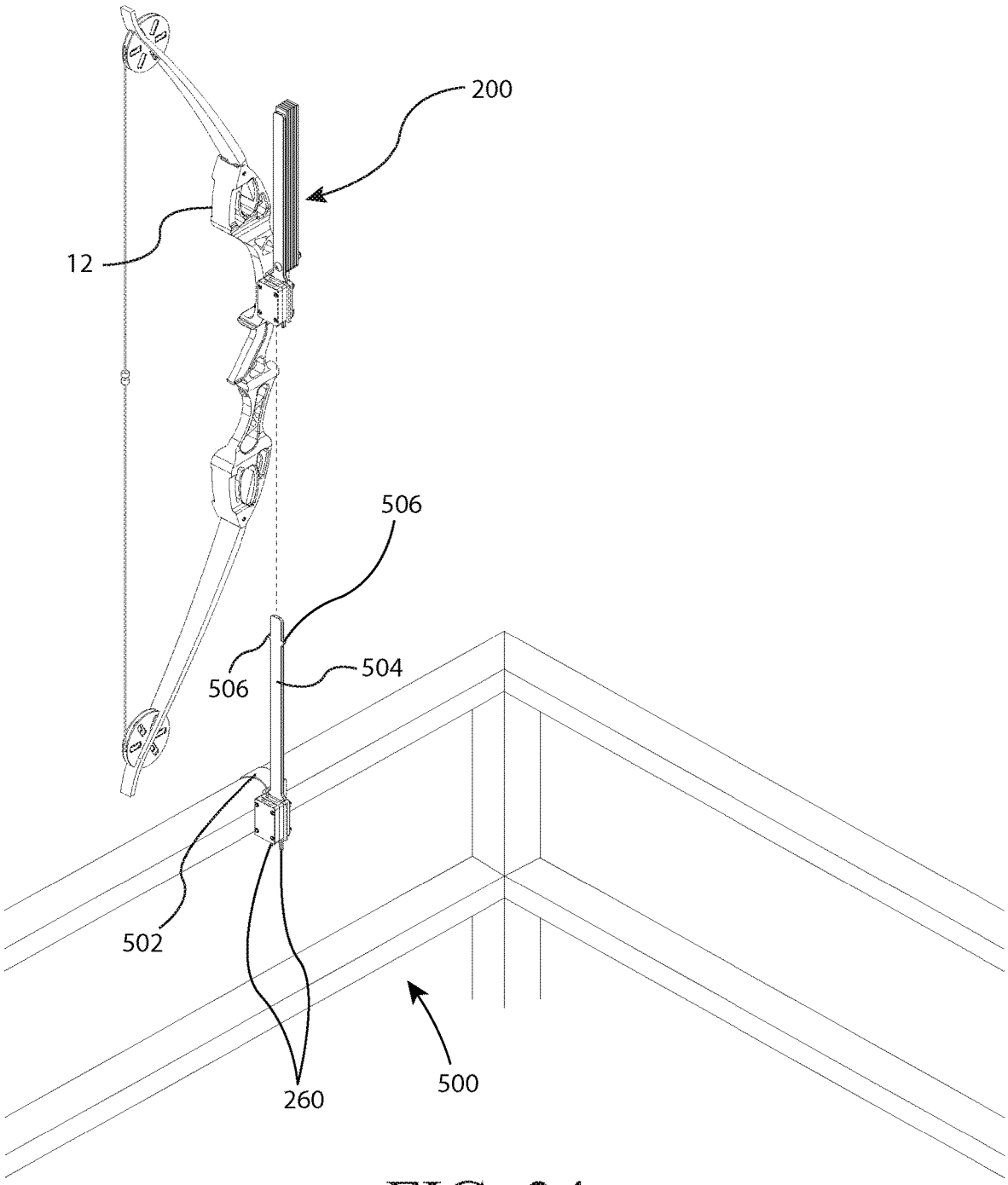
FIG. 34 is an illustrative perspective view of a version of the application that provides a hunting bow docking station.

FIG. 34 shows a perspective view of a mounting bracket assembly 204 that is secured to a tree stand 500 railing by a hook and loop fastener 502, functioning as a bow docking station. The mounting bracket assembly 204 provides a longitudinal slot 258 for receipt of an upward extending support shaft 504 having stop tabs 506 positioned at each end. Therefore, an archery bow 12 having a mounting bracket assembly 204 with an available longitudinal slot 258 can seat the upward extending support shaft 504 into the longitudinal slot 258, seating on the stop tabs 506, thereby docking the archery bow 12 when not in use. To retrieve and use the archery bow 12, just lift it upward from the docking station.

The disclosed embodiments of the bow blind 100, 200 are versatile and adaptable, allowing for various modifications and enhancements to meet different hunting scenarios and user preferences. The following additional embodiments illustrate the potential for further customization and improvement of the design.

Alternatively, the mounting bracket assemblies 104, 204 can be designed in various shapes and configurations to accommodate different types of bows and user preferences. For example, the bracket could be made from lightweight composite materials for increased portability or designed with a more ergonomic shape for easier handling. Additionally, alternative attachment and release mechanisms, such as magnetic mounts or quick-release clamps, could be used to provide faster and more secure attachment to the bow.

The flexible material 108, 208 for creating a visual barrier or shroud can be configured in various shapes, sizes, and materials to suit different hunting environments and conditions. For instance, interchangeable fan shrouds with different camouflage patterns or colors could be provided to match specific terrains. The fan shroud could also be made from more durable materials for use in harsh weather conditions or designed with additional features such as wind-resistant fabrics.

The quick disconnect system allows for the attachment of various accessories beyond the quiver 300 and camera mount 402. Potential accessories include rangefinders, GPS devices, additional storage compartments, or even small utility tools. These accessories can be easily attached and detached using structures that include a connection member 250, providing a modular system that can be customized based on the hunter's needs.

Alternatively, improvements to the release mechanism 274 and/or connection member 250 can enhance the user experience and increase the reliability of the system. For example, enhanced locking features could be added to ensure a more secure attachment, or more ergonomic designs could be implemented to make the release mechanism 274 easier to operate. Faster release mechanisms 274 could also be developed to allow for quicker changes of accessories in the field.

The bow blind 100, 200 can be integrated with modern technology to provide additional functionality. For example, sensors or cameras could be incorporated into the design to provide real-time tracking or recording of the hunt. These integrations could be particularly useful for documenting hunting experiences or for use in training and analysis.

While the best modes for carrying out the many aspects of the present teachings have been described in detail, those familiar with the art to which these teachings relate will recognize various alternative aspects for practicing the present teachings that are within the scope of the appended claims.

What is claimed is:

1. A bow blind configured for attachment to an archery bow, the bow blind comprising:

a fan portion; and a mounting bracket attached to the fan portion;

wherein the mounting bracket is operably attachable to the archery bow;

wherein the fan portion is configured to radially move between a retracted position and an unfurled position.

2. The bow blind of claim 1, wherein the fan portion includes a plurality of spokes and a flexible material operatively attached to the plurality of spokes; wherein when the bow blind is in the unfurled position, the flexible material is radially expanded, forming a radial visual barrier.

3. The bow blind of claim 2, wherein the plurality of spokes and the flexible material expand and retract between a uniform profile and a semi-circular profile.

4. The bow blind of claim 2, wherein the plurality of spokes includes a first outer spoke, a second outer spoke, and a plurality of inner spokes, with the plurality of inner spokes sandwiched between the first outer spoke and the second outer spoke.

5. The bow blind of claim 4, wherein each of the plurality of spokes is elongated in shape and extends between a proximal end and a distal end; wherein the plurality of spokes are aligned with one another along a pivot axis, near the proximal ends, such that the plurality of spokes pivot relative to one another about the pivot axis to move the flexible material between the retracted position and the unfurled position.

6. The bow blind of claim 5, wherein each of the plurality of spokes defines a pivot hole, near the respective proximal end, with the pivot holes aligned with one another along the pivot axis; wherein the radial fan portion further includes a rod extending along the pivot axis, through the pivot holes, to pivotally interconnect the spokes.

7. The bow blind of claim 4, wherein the mounting bracket is operatively attached to the first outer spoke.

8. The bow blind of claim 6, wherein the mounting bracket is formed from a single piece of material as an L-shaped bracket.

9. The bow blind of claim 8, wherein the mounting bracket includes a first leg and a second leg, extending from the first leg to define an angle therebetween.

10. The bow blind of claim 9, wherein the first leg defines a pair of openings; wherein the pair of openings are disposed in spaced apart relationship to one another configured to align with a pair of mounting holes provided on the archery bow.

11. The bow blind of claim 10, wherein the second leg of the mounting bracket is configured for attachment to the first outer spoke of the fan portion.

12. The bow blind of claim 5, wherein the fan portion further comprises a connection member; wherein the mounting bracket further includes a slotted mounting block defining a longitudinal slot, extending therethrough, configured to receive and engage with the connection member.

13. The bow blind of claim 12, wherein the connection member is integrally formed with the first outer spoke, near the proximal end, radially extending from the pivot axis.

14. The bow blind of claim 13, wherein the connection member further defines a pair of reciprocal squeeze tabs providing a gap therebetween to allow lateral flexing, each having an upper flat catch and a lower flat catch, which are configured to simultaneously couple with the longitudinal slot when the connection member is fully inserted into the slotted mounting block.

15. The bow blind of claim 14, wherein the mounting bracket further comprises and a sub-bracket extending from the slotted mounting block defining an angle therebetween, the sub-bracket defines a pair of openings that are disposed in spaced apart relationship to one another configured to align with a pair of mounting holes on the archery bow.

16. A bow blind configured for attachment to an archery bow, the bow blind comprising:

a fan portion comprising:

a plurality of spokes that are pivotally connected to one another at a pivot axis at a proximal end; and a flexible material operably connected to the plurality of spokes; and a mounting bracket configured to attach the fan portion to an archery bow;

wherein the fan portion is configured to radially move between a retracted position and an unfurled position;

wherein the plurality of spokes includes a first outer spoke, a second outer spoke, and a plurality of inner spokes, with the plurality of inner spokes sandwiched between the first outer spoke and the second outer spoke;

wherein each of the plurality of spokes is elongated in shape and extends between a proximal end and a distal end;

wherein the plurality of spokes are aligned with one another along a pivot axis, near the proximal ends, such that the plurality of spokes pivot relative to one another about the pivot axis to move the flexible material between the retracted position and the unfurled position.

17. The bow blind of claim 16, wherein each of the plurality of spokes defines a pivot hole, near the respective proximal end, with the pivot holes aligned with one another along the pivot axis; wherein the fan portion further includes a rod extending along the pivot axis, through the pivot holes, to pivotally interconnect the plurality of spokes.

18. The bow blind of claim 16, wherein the mounting bracket is operatively attached to the first outer spoke.

19. The bow blind of claim 16, wherein the fan portion further comprises a connection member; wherein the mounting bracket further includes a slotted mounting block defining a longitudinal slot, extending therethrough, configured to receive and engage with the connection member.

20. The bow blind of claim 19, wherein the connection member is integrally formed with the first outer spoke, near the proximal end, radially extending from the pivot axis.

21. The bow blind of claim 20, wherein the connection member defines a pair of reciprocal squeeze tabs providing a gap therebetween to allow lateral flexing, each having an upper flat catch and a lower flat catch, which are configured to simultaneously couple with the longitudinal slot when the connection member is fully inserted into the slotted mounting block.

22. A bow blind configured for attachment to an archery bow, the bow blind comprising:

a fan portion comprising:

a plurality of spokes that are pivotally connected to one another at a pivot axis at a proximal end; and a flexible material operably connected to the plurality of spokes; and a mounting bracket configured to attach the fan portion to an archery bow;

wherein the fan portion is configured to radially move between a retracted position and an unfurled position;

wherein the plurality of spokes includes a first outer spoke, a second outer spoke, and a plurality of inner spokes, with the plurality of inner spokes sandwiched between the first outer spoke and the second outer spoke;

wherein each of the plurality of spokes is elongated in shape and extends between a proximal end and a distal end;

wherein the plurality of spokes are aligned with one another along a pivot axis, near the proximate ends, such that the plurality of spokes pivot relative to one another about the pivot axis to move the flexible material between the retracted position and the unfurled position;

wherein the fan portion further comprises a connection member; wherein the mounting bracket further includes a slotted mounting block defining a longitudinal slot, extending therethrough, configured to receive and engage with the connection member;

wherein the connection member is integrally formed with the first outer spoke, near the proximal end, radially extending from the pivot axis;

wherein the connection member defines a pair of reciprocal squeeze tabs providing a gap therebetween to allow lateral flexing, each having an upper flat catch and a lower flat catch, which are configured to simultaneously couple with the longitudinal slot when the connection member is fully inserted into the slotted mounting block.

* * * * *